US006909442B2

(12) United States Patent
Hiyama et al.

(10) Patent No.: US 6,909,442 B2
(45) Date of Patent: Jun. 21, 2005

(54) DISPLAY DEVICE FOR DECOMPRESSING COMPRESSED IMAGE DATA RECEIVED

(75) Inventors: Ikuo Hiyama, Hitachinaka (JP); Tsunenori Yamamoto, Hitachi (JP); Akitoyo Konno, Hitachi (JP); Makoto Tsumura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 274 days.

(21) Appl. No.: 10/224,383

(22) Filed: Aug. 21, 2002

(65) Prior Publication Data

US 2003/0117422 A1 Jun. 26, 2003

(30) Foreign Application Priority Data

Dec. 20, 2001 (JP) ..... 2001-386897

(51) Int. Cl.[7] ..... G09G 5/00; G09G 5/02; G09G 5/10

(52) U.S. Cl. ..... 345/690; 345/204; 345/698

(58) Field of Search ..... 345/204, 690, 345/694–698, 418–432, 473–474

(56) References Cited

U.S. PATENT DOCUMENTS 5,870,097 A * 2/1999 Snyder et al. ..... 345/426
6,252,608 B1 * 6/2001 Snyder et al. ..... 345/473

* cited by examiner

*Primary Examiner*—Vijay Shankar
(74) *Attorney, Agent, or Firm*—Antonelli, Terry, Stout & Kraus, LLP

(57) ABSTRACT

A display device including a plurality of blocks of pixels each of which includes a red subpixel, a green subpixel, and a blue subpixel, each of the blocks including pixels in a form of a matrix having N rows and M columns includes a first active element shared among three subpixels of each pixel and a second active element connected to a second active element formed in each subpixel connected to the first active element. Ma gradation voltage lines (Ma is an integer; M≧Ma≧2) respectively of red, green, and blue subpixels in a direction of the column are commonly connected. The display device directly displays a compressed image signal without developing the image signal into a bit map in which each subpixel has gradation information.

19 Claims, 16 Drawing Sheets

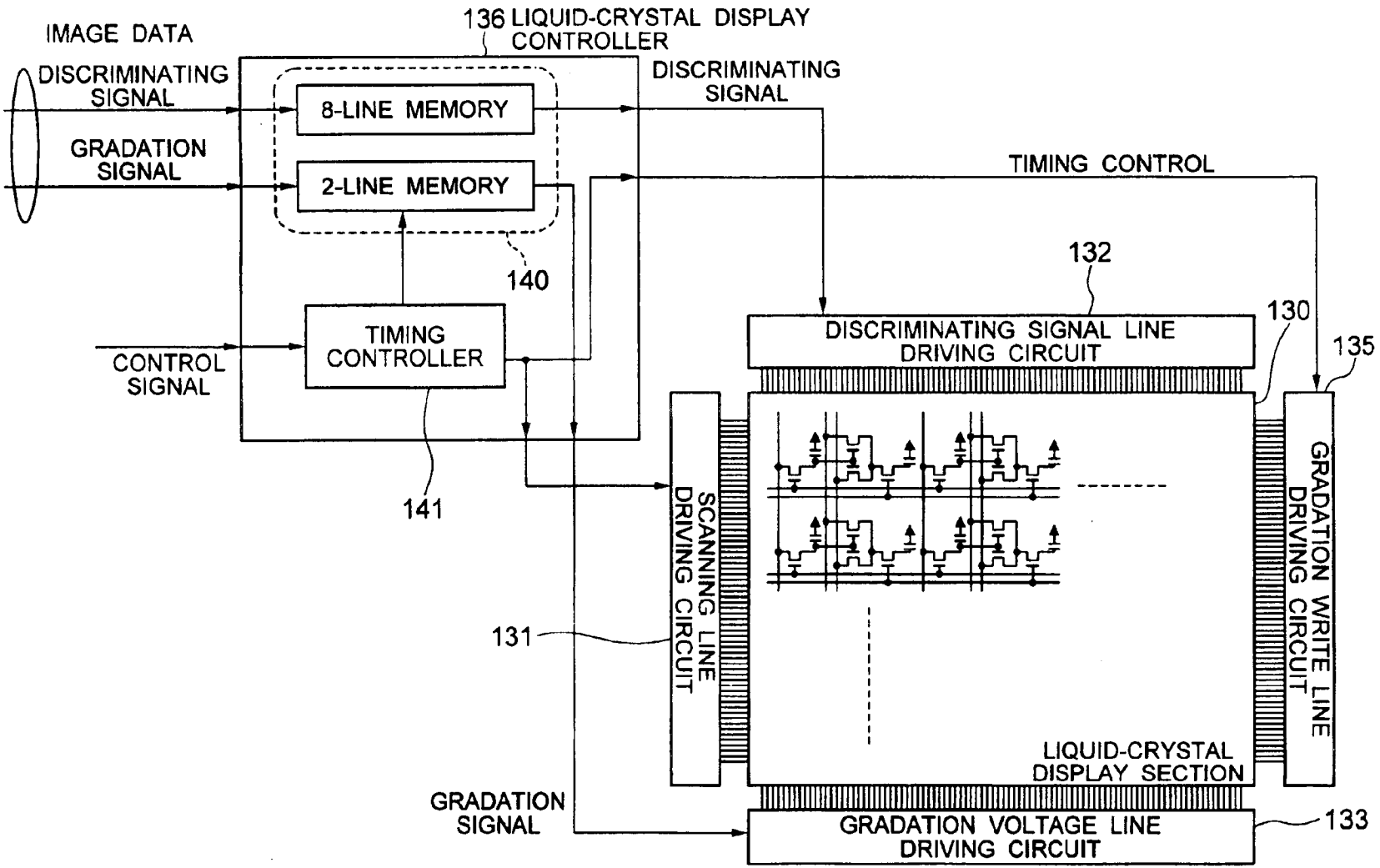
FIG. 8
IMAGE DATA
DISCRIMINATING SIGNAL
GRADATION SIGNAL
CONTROL SIGNAL
136 LIQUID-CRYSTAL DISPLAY CONTROLLER
8-LINE MEMORY
2-LINE MEMORY
140
TIMING CONTROLLER
141
DISCRIMINATING SIGNAL
TIMING CONTROL
132
DISCRIMINATING SIGNAL LINE DRIVING CIRCUIT
130
135
GRADATION WRITE LINE DRIVING CIRCUIT
LIQUID-CRYSTAL DISPLAY SECTION
133
GRADATION VOLTAGE LINE DRIVING CIRCUIT
SCANNING LINE DRIVING CIRCUIT
131
GRADATION SIGNAL STILL PICTURE
$1-0 \neq 2-0$
$1-1 \neq 2-1$

DISPLAY BLOCK (4 SUBPIXELS × 4 SUBPIXELS) IN 4 GRADATION LEVELS

REWRITE WITH 2 FRAMES

MOTION PICTURE
$1-0 \approx 2-0$
$1-1 \approx 2-1$

DISPLAY BLOCK (4 SUBPIXELS × 4 SUBPIXELS) IN 2 GRADATION LEVELS

REWRITE WITH 1 FRAME

DISPLAY DEVICE FOR DECOMPRESSING COMPRESSED IMAGE DATA RECEIVED

BACKGROUND OF THE INVENTION

The present invention relates to a display device, and in particular, to a display device having a high frequency driving device suitable to display motion pictures with super high definition.

Thickness and weight of picture display devices have been decreased these days, and flat-panel displays (FPD) such as a liquid-crystal display, a plasma display panel (PDP), an electroluminescent (EL) display, and the like have been widely employed in place of a cathode-ray tube (CRT) primarily used as the picture display device. Techniques for a field emission display (FED) and the like are also rapidly being developed. Since personal computers, digital versatile discs, and digital broadcasting are broadly developed, it is required to display super high definition high-speed motion pictures. Requirement for higher performance of the picture display device, particularly, requirement for higher definition and speed of pictures will be needed also in future. In this connection, a liquid-crystal display going ahead of a flat panel display (FDP) is highly expected.

Description will be given of a thin-film transistor (TFT) active matrix driving method as a typical liquid-crystal display driving method of the background art. A TFT active matrix liquid-crystal display is driven in a line sequential scanning method in which a scanning pulse is applied to each scanning electrode for each frame period of time. The frame period of time is usually set to about 1/60 second (s). The pulse is ordinarily applied in a direction from an upper side of the panel to a lower side thereof by sequentially shifting timing of the pulse. Therefore, in a liquid-crystal display configured as 1024 subpixels by 768 subpixels, 768 gate interconnection lines are scanned for each frame. Time width of the scanning pulse is consequently about 20 microseconds ($\mu$s)≈(1/60)×(1/768) s.

On the other hand, at timing synchronized with the scanning pulse, a liquid-crystal driving voltage is applied at a time to signal electrodes for liquid crystal of one row to which the scanning pulse is applied. In one of the selected subpixels to which the gate pulse is applied, a gate electrode voltage of a thin film transistor (TFT) connected to the scanning electrode becomes higher to turn the transistor on. In this state, the liquid-crystal driving voltage is applied via a region between a source and a drain of the transistor to a display electrode. As a result, subpixel capacity including liquid-crystal capacity between the display electrode and an opposing electrode formed on an opposing substrate and load capacity of a load on the subpixel is charged during the period of 20 $\mu$s described above. By repeatedly conducting the operation, the liquid-crystal apply voltage is repeatedly applied to subpixel capacity of the overall panel for each frame period of time.

The display device of the background art is operated in the TFT active matrix driving method as above. Therefore, with increase in the number of subpixels for higher definition display, the width of time of the scanning pulse becomes shorter. That is, the subpixel capacity must be charged during a short period of time. Additionally, to display high-speed motion pictures, it is required to reduce one frame period of time. This also minimizes the time width of the scanning pulse.

In other words, the image display methods and the image display driving methods of the background art are attended with delay of signals on interconnection lines, insufficient time to apply data in each subpixel, increase in the scanning frequency, and the like. Therefore, it is difficult to cope with the increase in the display frequency to display a picture with higher definition.

Deterioration in quality of a motion picture displayed on a hold emission display device such as a liquid-crystal display is described, for example, in pages 19 to 26 of Technical Report of the Institute of Electronics, Information and Communication Engineers EID96-4 (1996-06). According to EID96-4, the eyes of a human watching the motion picture can appropriately follow a motion picture produced by hold emission. Therefore, this causes blur in the motion picture to resultantly reduce the picture quality. The article also describes a method to improve the deteriorated picture quality of the motion picture, for example, a method in which the frame frequency is multiplied by n. In the method, the display frequency is increased when a motion picture is clearly displayed on a hold emission image display device such as a liquid-crystal display. However, the display frequency is approaching its upper limit in the image display method and the image display driving methods at the present stage of the technique as already described above.

To cope with increasing requirements for high definition display of motion pictures, new materials have been discussed to reduce interconnection resistance and interconnection capacity, which are factors to delay signals on the interconnection line. To increase performance of writing data in subpixels, a TFT using polycrystalline silicon in place of the background-art TFT using amorphous silicon has been recently put to the market.

JP-A-08-006526 describes a liquid-crystal display device including a unit to conduct change-over between one-line selection and multi-line simultaneous selection to thereby change resolution. However, the resolution is fixed for each line in the technique. The article does not described any method of achieving both of the high definition display and the high-speed display. JP-A-09-329807 describes a liquid-crystal display device including a block selecting unit to save power consumption. The device conducts a re-writing operation in a block unit only for an image of which the contents have been re-written. However, during the motion picture display operation in which the overall screen is re-written, high-speed display of a motion picture is difficult due to the delay of signals on the interconnection line and the restricted performance of data writing operation.

Description will now be given of transmission of an image from an image controller (a graphic controller board) for high definition display and high-speed display to an image display device. Assume that the image display device is, for example, a liquid-crystal display of the background art including a display screen of "1204×768 subpixels"; each of red, green, and blue is represented by eight bits (for about 1.6 million colors), and the frame frequency is 60 Herz (Hz). The bit rate is then about 1.1 gigabits per second (Gbps). Such data cannot be transferred through one data line. To overcome the difficulty, 24 data lines are used to reduce the bit rate of each data line to transmit data to the liquid-crystal display panel. In short, because of the increase in the number of pixels and the increase in the frequency to cope with the high definition display and the high-speed display, the image processing in the image controller and the data transmission between the image controller and the image display device become difficult.

To increase the amount of information to be displayed, four problems exist as described above. (1) Improvement of substantial display data transfer performance, (2) increase in processing performance of a data processor in the display device, (3) increase in display performance of the display device, and (4) reduction in the aperture ratio associated with improvement of definition and resolution for displayed images.

For item (1), namely, for the improvement of substantial display data transfer performance, there have been considered a digital PV (Packet Video) link method in which an image is compared with an image of an image of an immediately preceding frame to transfer only data of an image area of which the contents are changed and a method in which an image is compressed such that the compressed image is not perceived by eyes of a human so as to transfer the compressed data as described in page 38 of "SID '00 Digest".

For item (3), namely, for the increase in display performance of the display device, there exits a display method in which according to the increase in the display frequency, the image is re-written at a high speed to thereby display the image. For example, JP-A-11-075144 describes a display method in which for each subpixel of optical spatial modulating device, two memories, i.e. first and second memories and a driving unit to drive the subpixel according to the contents of the memories are disposed. For all pixels of an image to be displayed, data is written in the first memory in advance. Thereafter, data is transferred at a time to all subpixels of the second memory. According to the data in the second memory, the driving unit controls a state, namely, on or off of light in each pixel at a high speed to display a multi-level image by pulse width modulation (PWM).

However, when a display device of the background art receives data in the PV link method or the image compression method, the display device cannot directly display the received image data. Therefore, the second problem must be solved, namely, the increase in processing performance of a data processor in the display device must be achieved. Moreover, since nothing has been conducted for item (3), the image cannot be normally displayed.

When the method described in JP-A-11-075144 is employed for item (3), the display data thus received cannot be directly displayed because pulse width modulation (PWM) is used in the multi-level display method. Therefore, it is required to enhance item (2), namely, to further increase the processing performance. Increase in the processing circuit considerably increases the cost.

For item (4), namely, the reduction in the aperture ratio associated with improvement of definition and resolution for displayed images, the driving method of the background art has discussed in various ways. However, a display method of displaying an image using an image compression method has not been discussed at all.

SUMMARY OF THE INVENTION

It is therefore a first object of the present invention to provide display device in which (1) display data with substantially improved transfer performance using the digital PV link method or the image compression method is received, (2) the processing performance of the data processor is only slightly improved and hence the cost is not increased, and (3) a large amount of information can be normally displayed.

A second object of the present invention is to provide display device in which to expand a compressed image in the display device, the wiring and active elements are increased and the aperture ratio is reduced, and hence there exists a fear of reduction in brightness; however, the reduction in the aperture ratio is compensated to improve the brightness.

An embodiment of the display device of the present specification includes a plurality of blocks of pixels each of which includes subpixels respectively of three colors such as red, green, and blue. Each of the blocks includes pixels in a form of a matrix having N rows and M columns. The display device directly displays a compressed image signal without developing the signal into a bit map in which each subpixel has gradation information.

The display device includes a plurality of blocks of pixels each of which includes subpixels respectively of three colors, each of the blocks including pixels in a form of a matrix having N rows and M columns, a subpixel electrode disposed in each said pixel; a display element disposed in said each subpixel, said element operating according to a voltage on said subpixel electrode; a scanning line driving circuit for supplying a scanning signal to scanning lines arranged substantially parallel to each other; a discriminating signal line driving circuit for supplying a discriminating signal to discriminating signal lines arranged substantially vertical to said scanning lines; holding means for holding in said pixel a discriminating signal from said discriminating line; a gradation voltage line driving circuit for supplying a gradation voltage to Ma gradation voltage lines of said gradation voltage lines for supplying a gradation voltage to each said subpixel, said Ma gradation voltage lines being commonly connected (Ma is an integer; $M \geqq Ma \geqq 2$) for said subpixels respectively of three colors in a direction of the column; a circuit for selecting a gradation voltage according to said discriminating signal; and a switch for applying the gradation voltage selected by said selecting circuit to said subpixel electrode. The display element is a light modulating element using liquid crystal, the holding circuit includes a first active element which includes said scanning line as a gate terminal thereof and which is respectively shared among subpixels respectively of the three colors connected to said discriminating line and intra-pixel memory capacity, and two gradation voltage lines are arranged for one subpixel; said gradation voltage selecting circuit includes an n-type active element and a p-type active element of which respective gate terminals are connected to said intra-pixel memory capacity and which are respectively connected to two gradation voltage lines; and said switch includes a fourth active element connected to an (n,p)-type active element and said subpixel electrode, said fourth active element including a gradation write line as a gate terminal thereof.

As a result, the display device can expand the compressed image with a high aperture ratio to display the expanded image.

Moreover, to simplify the subpixel configuration said display element is a light modulating element using liquid crystal, said holding circuit includes a first active element which includes said scanning line as a gate terminal thereof and which is shared respectively among subpixels respectively of the three colors connected to said discriminating line and intra-pixel memory capacity, and one said gradation voltage line is arranged for one said subpixel; said circuit to output the gradation voltage to said subpixel electrode includes a second active element of which a gate terminal is connected to said intra-pixel memory capacity and which is connected to said gradation voltage line.

A display device according to another embodiment of the present invention includes a plurality of blocks of pixels each of which includes subpixels respectively of three colors, each of said blocks including pixels in a form of a matrix having N rows and M columns, wherein each said pixel includes a function of developing a compressed image signal into gradation information of each said subpixel.

A display device according to still another embodiment of the present invention includes a plurality of blocks of pixels each of which includes subpixels respectively of three colors, each of said blocks including pixels in a form of a matrix having N rows and M columns; a subpixel electrode disposed in each said pixel; a display element disposed in said each subpixel, said element operating according to a voltage on said subpixel electrode; a scanning line driving circuit for supplying a scanning signal to scanning lines arranged substantially parallel to each other; a discriminating signal line driving circuit for supplying a discriminating signal to discriminating signal lines arranged substantially vertical to said scanning lines; holding means for holding in said pixel a discriminating signal from said discriminating line; a gradation voltage line driving circuit for supplying a gradation voltage to Ma gradation voltage lines for supplying a gradation voltage to each said subpixel, said Ma gradation voltage lines being commonly connected (Ma is an integer; $M \geqq Ma \geqq 2$) for said subpixels respectively of three colors of red, green, and blue in a direction of the column; a circuit for selecting a gradation voltage according to said discriminating signal; and a switch for applying the gradation voltage selected by said selecting circuit to said subpixel electrode.

A display device according to another embodiment of the present invention includes a plurality of blocks of pixels each of which includes subpixels respectively of three colors, each of said blocks including pixels in a form of a matrix having N rows and M columns; a subpixel electrode disposed in each said pixel; a display element disposed in said each subpixel, said element operating according to a voltage on said subpixel electrode; a scanning line driving circuit for supplying a scanning signal to scanning lines arranged substantially parallel to each other; a discriminating signal line driving circuit for supplying a discriminating signal to discriminating signal lines arranged substantially vertical to said scanning lines; holding means for holding in said pixel a discriminating signal from said discriminating line; a gradation voltage line driving circuit for supplying a gradation voltage to Ma gradation voltage lines for supplying a gradation voltage to each said subpixel, said Ma gradation voltage lines being commonly connected (Ma is an integer; $M \geqq Ma \geqq 2$) for said subpixels respectively of three colors of red, green, and blue in a direction of the column; a circuit for selecting a gradation voltage according to said discriminating signal; and a switch for applying the gradation voltage selected by said selecting circuit to said subpixel electrode, wherein said scanning lines, said discriminating signal lines, and gradation voltage lines include three layers of metallic wiring including first, second, and third metallic wiring, and a coating-type insulation film is formed between said second metallic wiring and said third metallic wiring.

According to the present invention, display data with substantially improved transfer performance using the digital PV link method or the image compression method associated with a spatial axis, a gradation axis, and a time axis is received; the processing performance of the data processor circuit is only slightly improved, and hence the cost is not increased and a large amount of information can be normally displayed.

Other objects, features and advantages of the invention will become apparent from the following description of the embodiments of the invention taken in conjunction with the accompanying drawings.

BRIEF DESCRIPTION OF THE DRAWINGS

FIG. 8 is a block diagram showing an embodiment of a display device;

DESCRIPTION OF THE EMBODIMENTS

Description will now be given in detail of an embodiment of the present invention.

Embodiment 1

Figure 3:
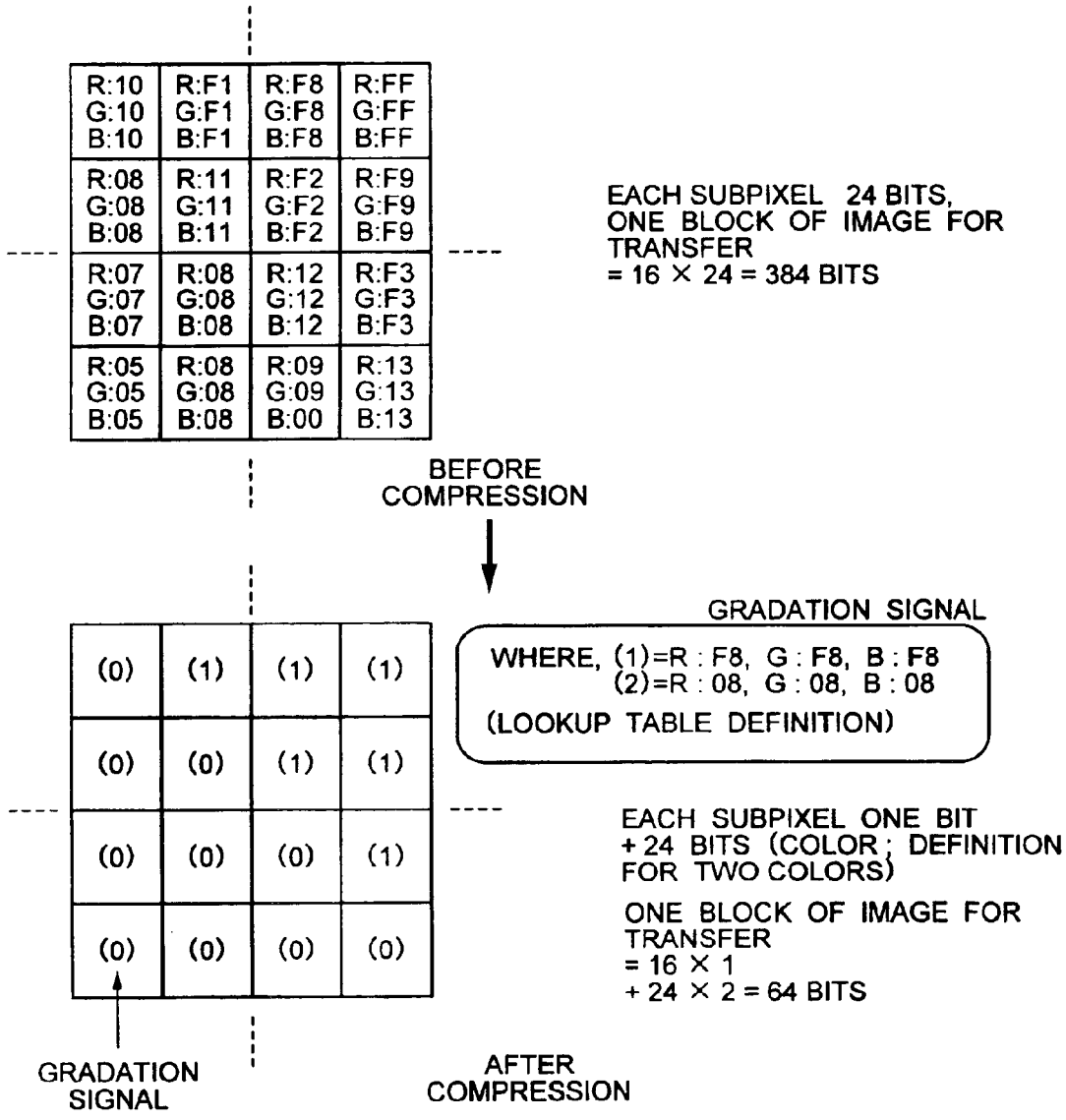
FIG. 3 is a diagram showing an image data layout to be received by the embodiment of the display device.

Referring now to FIG. 3, description will be given of a layout of display data which is received by the embodiment of a display device and which has substantially improved transfer performance.

Image data is usually represented as a set of pixels including gradation data for each color. For example, in an image format commonly used for a personal computer or the like, each pixel data is divided into three primary colors of light, namely, red (R), green (G), and blue (B). For each color, 256 gradation levels are indicated by eight bits. In this case, the amount of image information of one pixel is obtained as "8 bits×3 (colors)=24 bits". Image data of one screen represented by a set of data items of the pixels is called "bit map". In an image output source such as a personal computer, the bit map is stored in a memory. In an image output method of the background art, data items in a range from an upper-left corner of the bit map to a lower-right corner thereof are outputted in a dot sequential method. On the other hand, the display device receives the data sent in the dot sequential method, develops the data in the dot sequential method or in the line sequential method as described above to configure an image to be displayed. In this regard, some display devices include a memory for data of about one screen to execute display processing in which the received bit map is once developed in the memory to convert the bit map into a display format to be displayed.

In the method to dot sequentially output the bit map, when the amount of information of the image is increased, the band of the transmission system must be expanded as described above. To overcome this difficulty, several methods have been considered to compress the bit map before transfer thereof such that deterioration in the quality of the displayed image is only slightly recognized by the eyes of a human. FIG. 3 shows in an upper section thereof a data format of the bit map before compression. Assume that "4 pixels×4 pixels" form one block. The block contains an amount of information of 384 bits before compression. The block is compressed according to the following rules. (1) Assuming that "N pixels×M pixels" form one block (4 pixels×4 pixels in the embodiment), the block is approximated using two gradation levels. (2) These gradation levels are separately defined by a lookup data such that an discriminating signal defined by the table is assigned to each pixel.

In this case, information to be transferred includes two gradation information "24 bits×2" and the identifier information "one bit" for each pixel. The amount of data of the compressed block is 64 bits, which is one sixth of the original data. In the compression method, resolution is compressed in a spatial direction and the number of gradation levels is also compressed for the pixels of one block. That is, the compressed signal is a video signal compressed in a spatial axis and a gradation axis. In the display device of the embodiment, the video data to be received is configured as above, that is, each block includes 4 pixels×4 pixels and the gradation levels are compressed to two. However, the number of pixels of each block may be other than "4 pixels×4 pixels" and the gradation levels may also be compressed to other than two.

Figure 2:
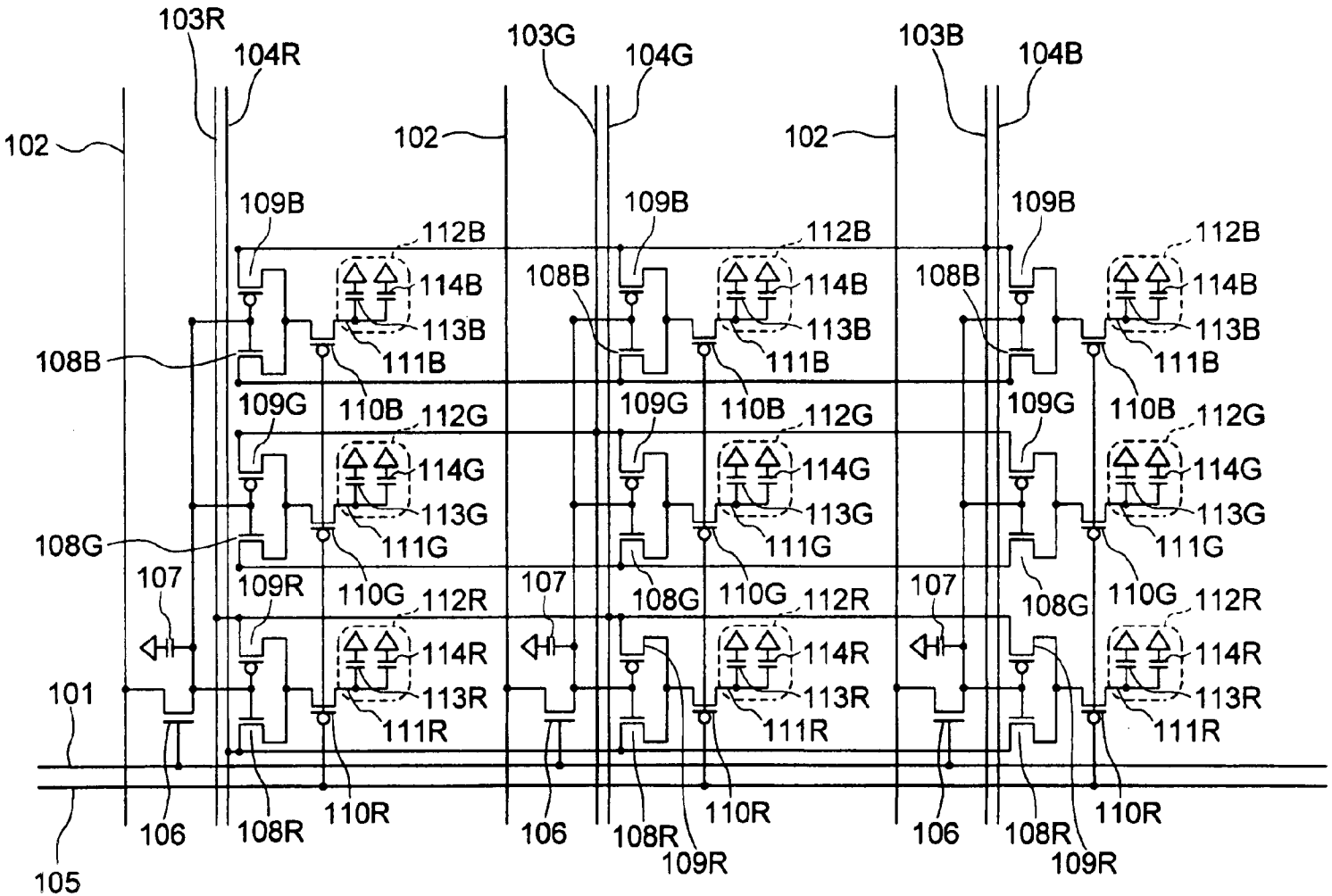
FIG. 2 is a diagram showing an equivalent circuit of a subpixel showing an embodiment of a display device.

FIG. 2 shows a circuit diagram of a subpixel in the embodiment of the display device. Letters R, G, and B after reference numerals respectively indicate that associated subpixels are a red subpixel, a green subpixel, and a blue subpixel, respectively. Scanning lines 101 and discriminating signal lines 102 are formed in a shape of a matrix. One first active element 106 is arranged at each intersection between the scanning lines 101 and the discriminating signal lines 102 such that the scanning line 101 is used as a gate terminal. When a selection voltage is applied to the scanning line 101, the first active element 106 writes the potential of the discriminating signal line 102 in a intra-pixel memory 107. The potential of the line 102 is a voltage obtained by converting the discriminating signal of each pixel described in conjunction with FIG. 3. The discriminating signal potential written in the intra-pixel memory 107 sets an n-type active element 108 or a p-type active element 109 to a conductive state. Resultantly, a voltage applied to a gradation voltage line 1 (103) or 2 (104) connected to the active element in the conductive state is outputted to a fourth active element 110. The voltage applied to a gradation voltage line 1 (103) or 2 (104) is a voltage obtained by converting the gradation signal defined by the lookup table for each block described in conjunction with FIG. 3. As can be seen from FIG. 2, the gradation voltage lines 1 (103) and 2 (104) can be shared among red, green, and blue subpixels for three pixels and hence the number of wiring lines can be remarkably reduced. The sharing of gradation voltage lines is not limited to three pixels, but can be applied to Ma wiring lines (Ma is an integer; $M \geqq Ma \geqq 2$) when each pixel block includes N rows and M columns. By sharing the first active element 106 among red, green, and blue subpixels, the number of active elements can be remarkably reduced. The aperture ratio can be improved by reducing the numbers respectively of wiring lines and active elements.

When a selection voltage is thereafter applied to a gradation write line 105, the fourth active element 110 becomes conductive and hence a gradation voltage is outputted to a subpixel electrode 111. The voltage of the electrode 111 controls a light modulating element 112 to display an image. In the embodiment, the light modulating element 112 includes a capacitor 113 and liquid crystal 114. Transmission light through the liquid crystal is modulated by electrooptic effect of the liquid crystal.

Figure 4:
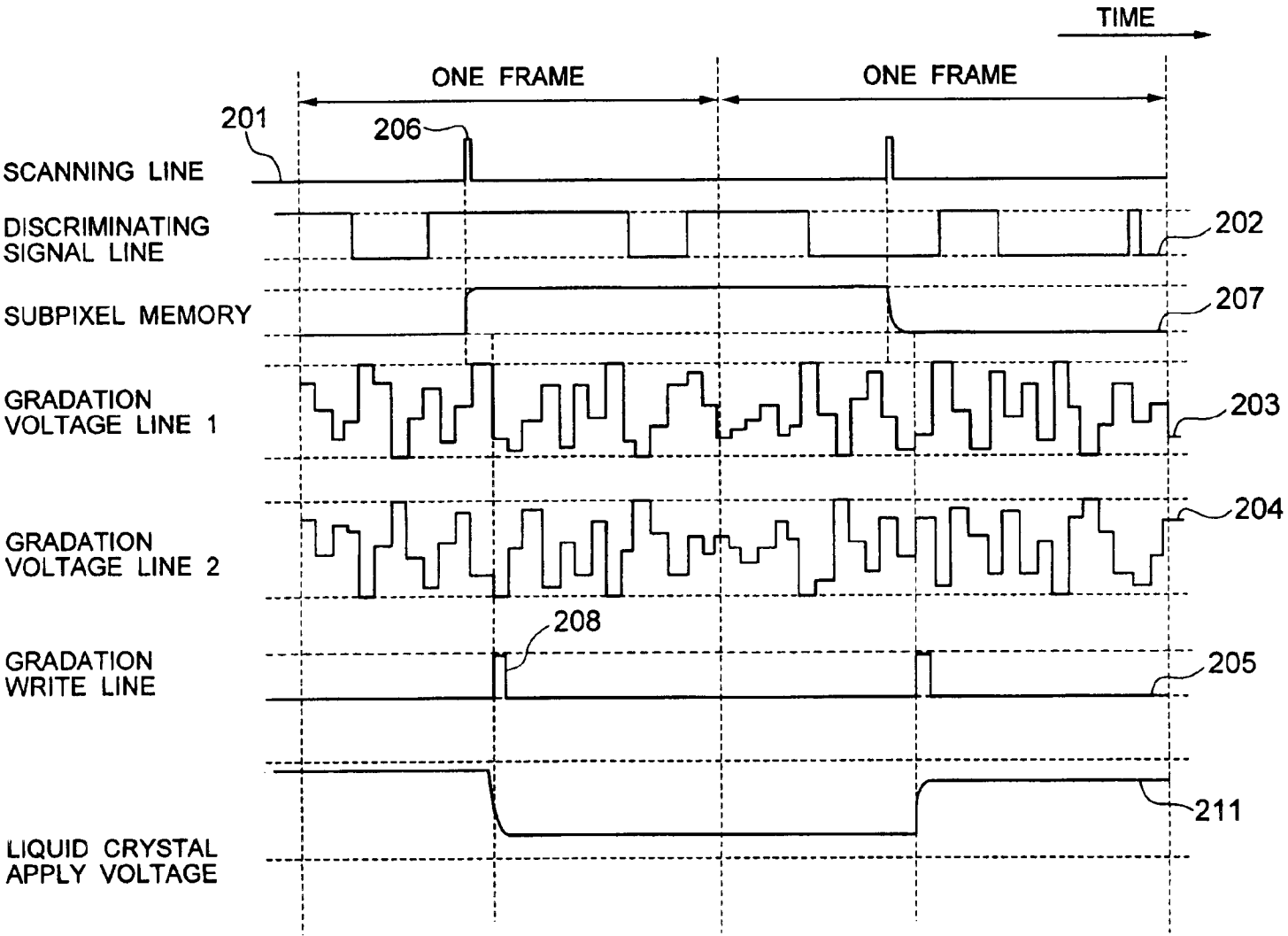
FIG. 4 is a timing chart showing a driving method of the embodiment of the display device.

Next, referring to FIG. 4, description will be given of a driving method in the embodiment of the display device.

Since each block includes pixels configured in 4 rows×4 columns in the embodiment, the driving method is also considered according to a unit of four rows. However, FIG. 4 shows one of the driving method of driving one subpixel of the block.

The scanning lines are scanned in a direction from an upper position to a lower position by a progressive or sequential scanning pulse 206 as in the background art. When a scanning pulse 206 is inputted to a scanning line potential 201, potential 202 of the discriminating signal line is transferred to an intra-pixel memory potential 207 as described above. At any point of time, the potential of the discriminating signal line is at a digital potential level, i.e., high (Hi) or low (Lo). The value written in the intra-pixel memory 107 has precision only to exceed a threshold voltage of the n-type or p-type active element. Therefore, even when the scanning lines are scanned at a high speed and hence width of time of the scanning pulse 206 becomes shorter, a write operation can be fully conducted.

When the write operation of the discriminating signal in the intra-pixel memory 107 is completed for four rows, a gradation write pulse 208 is applied to potential 205 of the gradation write lines of four rows for a period of scanning pulses of four rows.

That is, while the progressive scanning of the scanning lines 101 is conducted in a row-by-row fashion, the scanning of the gradation write lines 105 is conducted in a unit of four rows.

In response to the write pulse 208, the gradation voltage is written from the gradation voltage line 1 or 2 in the subpixel electrode 111. Since a period of time of four scanning pulses are provided, even an analog voltage value with precision of 256 gradation levels can be fully written in the subpixel electrode 111.

According to the subpixel configuration and the driving method, the period of time used to write the gradation voltage with high precision can be four times that of scanning time of one row. Therefore, the speed of the line-sequential scanning can be about four times that of the background art, and an accordingly increased amount of information can be appropriately displayed.

Figure 1:
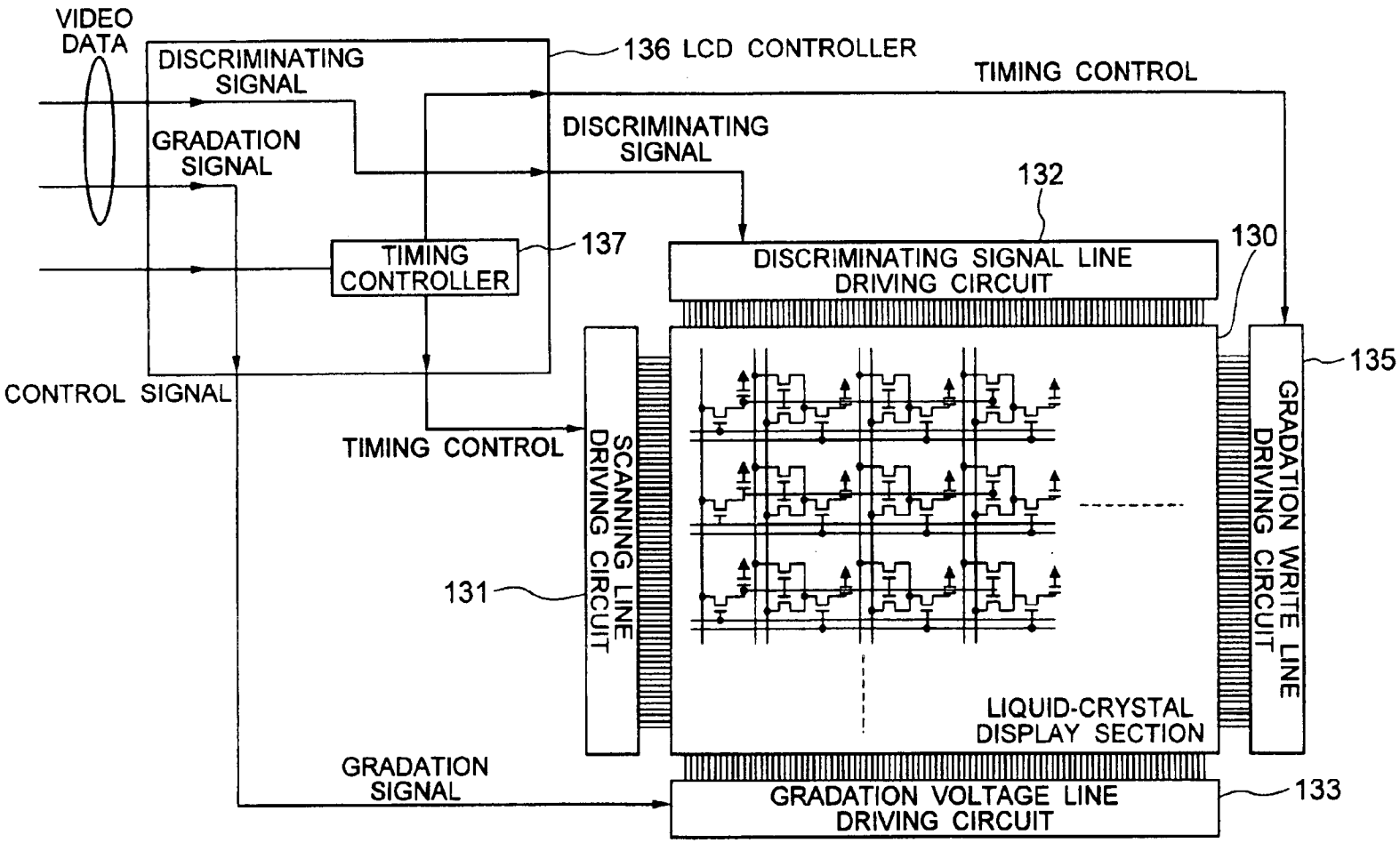
FIG. 1 is a block diagram showing an embodiment of a display device.

FIG. 1 shows a general block diagram of the embodiment of the display device.

A liquid-crystal display section 130 includes pixels in a shape of a matrix as shown in FIG. 2. Wiring to groups of the pixels are the scanning lines 101, the discriminating signal lines, the gradation voltage lines 1 (103), the gradation voltage lines 2 (104), and the gradation write lines 105. These lines are respectively driven by a scanning line driver circuit 131, a discriminating signal line driver circuit 132, a gradation voltage line driver circuit 133, and a gradation write line driver circuit 135. The driver circuits are controlled by a liquid-crystal display controller 136. In the configuration, the controller receives, from an image signal source, image data including an discriminating signal and a gradation signal and control signals including a vertical sync signal, a horizontal sync signal, and a dot clock signal. The controller 136 does not conduct an operation to develop the signals into a bit map, but conducts only timing adjustment for the received signals by a timing controller and outputs the signals.

The embodiment of the display device described above operates as follows. (1) The embodiment receives a video signal obtained by compressing data in a spatial axis and in a gradation axis, the data being in a unit of blocks each containing 4 pixels×4 pixels. (2) The received data is not developed into a bit map, but is used directly as display data, and hence it is not required to increase the circuit size of the display controller and the system can be configured at a low cost. (3) The embodiment can be driven at a high speed and a large amount of information can be therefore appropriately displayed.

In addition, the gradation voltage lines 1 (103) and 2 (104) can be shared among the red, green, and blue subpixels for four pixels (three pixels shown in FIG. 2) to remarkably reduce the number of wiring lines. The sharing of gradation voltage lines is not limited to four pixels, but can be applied to Ma wiring lines (Ma is an integer; $M \geqq Ma \geqq 2$) when each pixel block includes N rows and M columns. By sharing the first active element 106 among red, green, and blue subpixels, the number of active elements can be remarkably reduced. The aperture ratio can be improved by reducing the numbers respectively of wiring lines and active elements. Therefore, when compared with a display device having a backlight substantially equal to that of the embodiment, the displayed image becomes brighter according to the present invention. Additionally, since the number of wiring lines per pixel decreases, the number of short circuits between the wiring lines is reduced in the production of the display device to improve yield. Therefore, the display device can be produced at a low cost.

Although each block includes 4 pixels×4 pixels in the embodiment, each block may include N pixels×M pixels in the same configuration using the same driving method.

Embodiment 2

The second embodiment is substantially equal in structure to the first embodiment excepting features described below.

Figure 5:
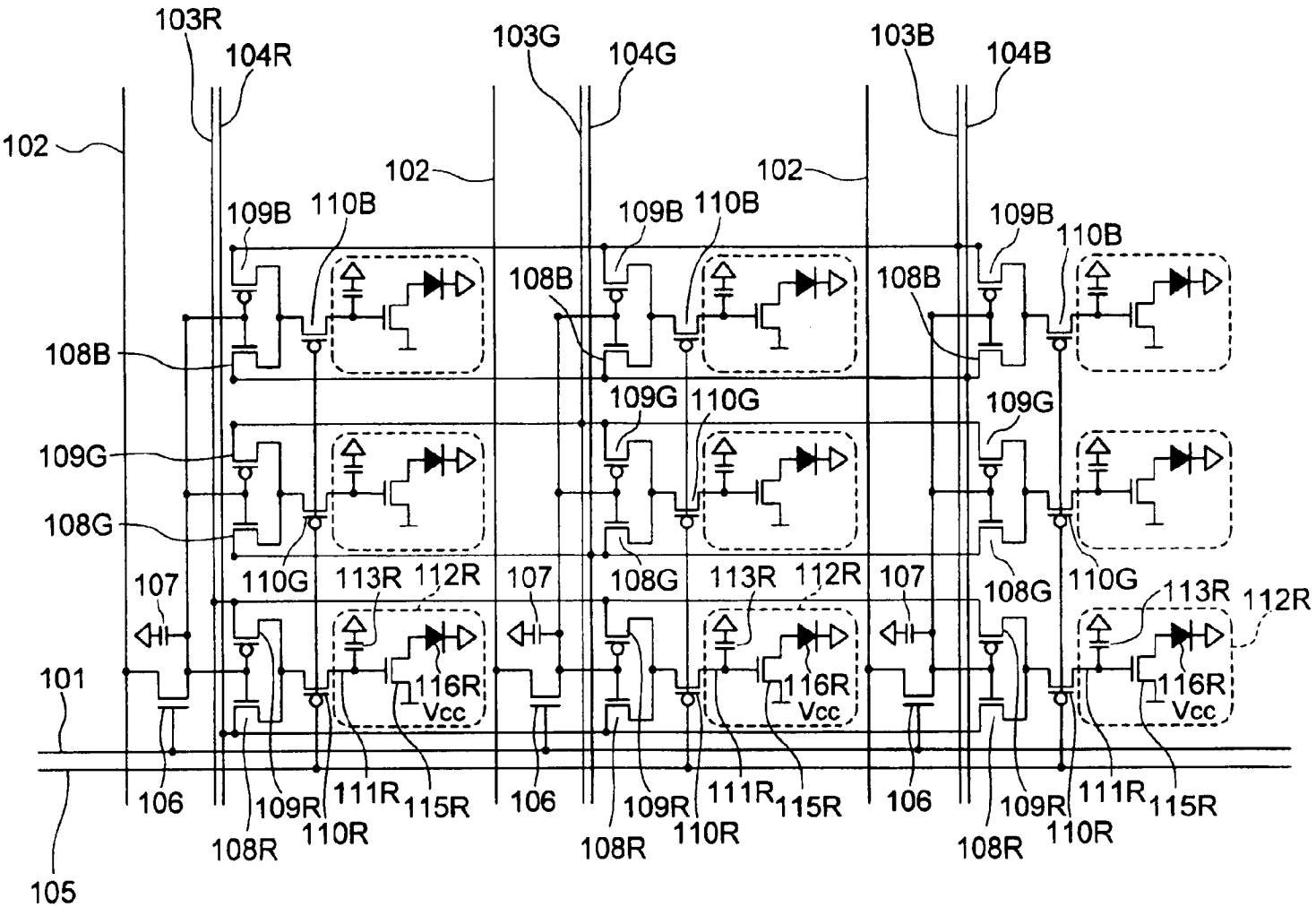
FIG. 5 is a diagram showing an equivalent circuit of a subpixel showing an embodiment of a display device.

FIG. 5 shows a subpixel of the embodiment of the display in a circuit diagram. In the second embodiment, the configuration is substantially the same as that of the first embodiment up to the fourth active element 110. However, a light modulating element 112 of the second embodiment is a light modulating element using a light emitting diode (LED) and includes a capacitor 113, a fifth active element 115 including a subpixel electrode 111 as a gate terminal, and an LED element 116 connected via the fifth active element 115 to a current source. The gradation voltage written in the subpixel electrode 111 is simultaneously written also in the capacitor 113. The voltage drives the fifth active element 115 to control a current flowing through the LED element 116 to resultantly modulate a quantity of emitted light. In this way, when an LED light modulating element is employed as the light modulating element 112, the response characteristic of the element is higher than that of a light modulating element using liquid crystal. Therefore, the period of time to write the gradation voltage can be reduced and the line-sequential scanning can be conducted at a higher speed. The display device can hence display an increased amount of information.

As above, the second embodiment operates as follows. (1) The second embodiment receives, as in the first embodiment, a video signal obtained by compressing data in a spatial axis and in a gradation axis, the data being in a unit of blocks each containing 4 pixels×4 pixels. (2) The received data is not developed into a bit map, but is used directly as display data, and hence it is not required to increase the circuit size of the display controller and the system can be configured at a low cost. (3) The second embodiment can be driven at a higher speed when compared with the first embodiment and hence a larger amount of information can be appropriately displayed.

In addition, the gradation voltage lines 1 (103) and 2 (104) can be shared among the red, green, and blue subpixels for four pixels (three pixels shown in FIG. 5) to remarkably reduce the number of wiring lines. The sharing of gradation voltage lines is not limited to four pixels, but can be applied to Ma wiring lines (Ma is an integer; $M \geqq Ma \geqq 2$) when each pixel block includes N rows and M columns. By sharing the first active element 106 among red, green, and blue subpixels, the number of active elements can be remarkably reduced. The aperture ratio can be improved by reducing the numbers respectively of wiring lines and active elements. Therefore, when compared with a display device having a backlight substantially equal to that of the embodiment of the present invention, the displayed image becomes brighter according to the present invention. Additionally, since the number of wiring lines per pixel becomes smaller, the number of short circuits between the wiring lines is reduced in the production of the display device to improve yield. Therefore, the display device can be produced at a low cost.

Embodiment 3

The third embodiment is substantially equal in structure to the first embodiment excepting features described below.

Figure 6:
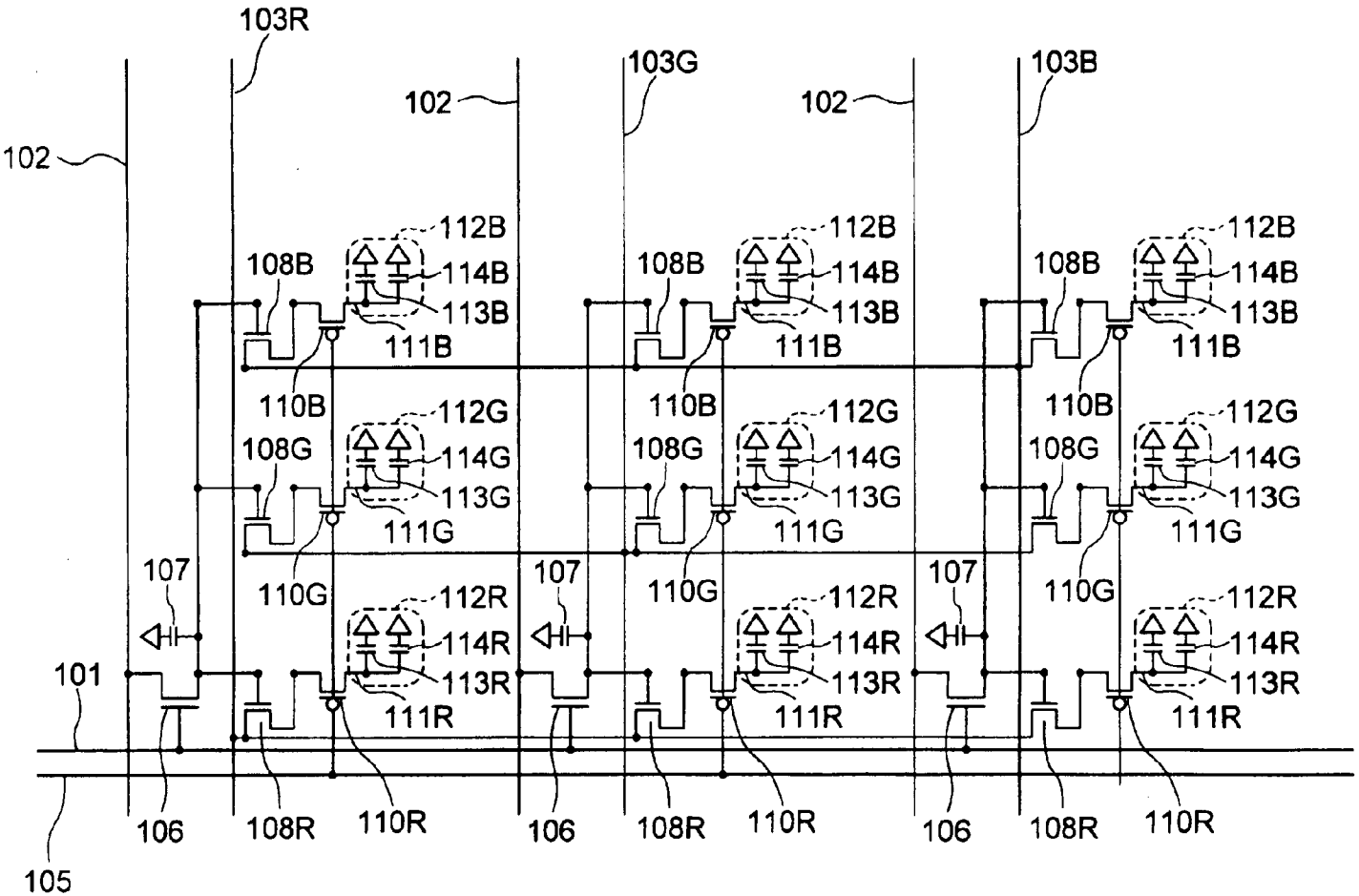
FIG. 6 is a diagram showing an equivalent circuit of a subpixel showing an embodiment of a display device.

FIG. 6 shows a subpixel of the embodiment of the display in a circuit diagram. While two gradation voltage lines 1 and 2 are connected to each subpixel in the first embodiment, only one gradation voltage line is connected to each subpixel in this embodiment. Since the second embodiment includes only a second active element corresponding to the n-type active element 108 and does not include any element as a p-type active element, all active elements in the pixels are unipolar elements. Therefore, the active elements can be produced only in a unipolar production process or can be produced in a production method only applicable to unipolar active elements. In either case, the production cost can be reduced.

Figure 7:
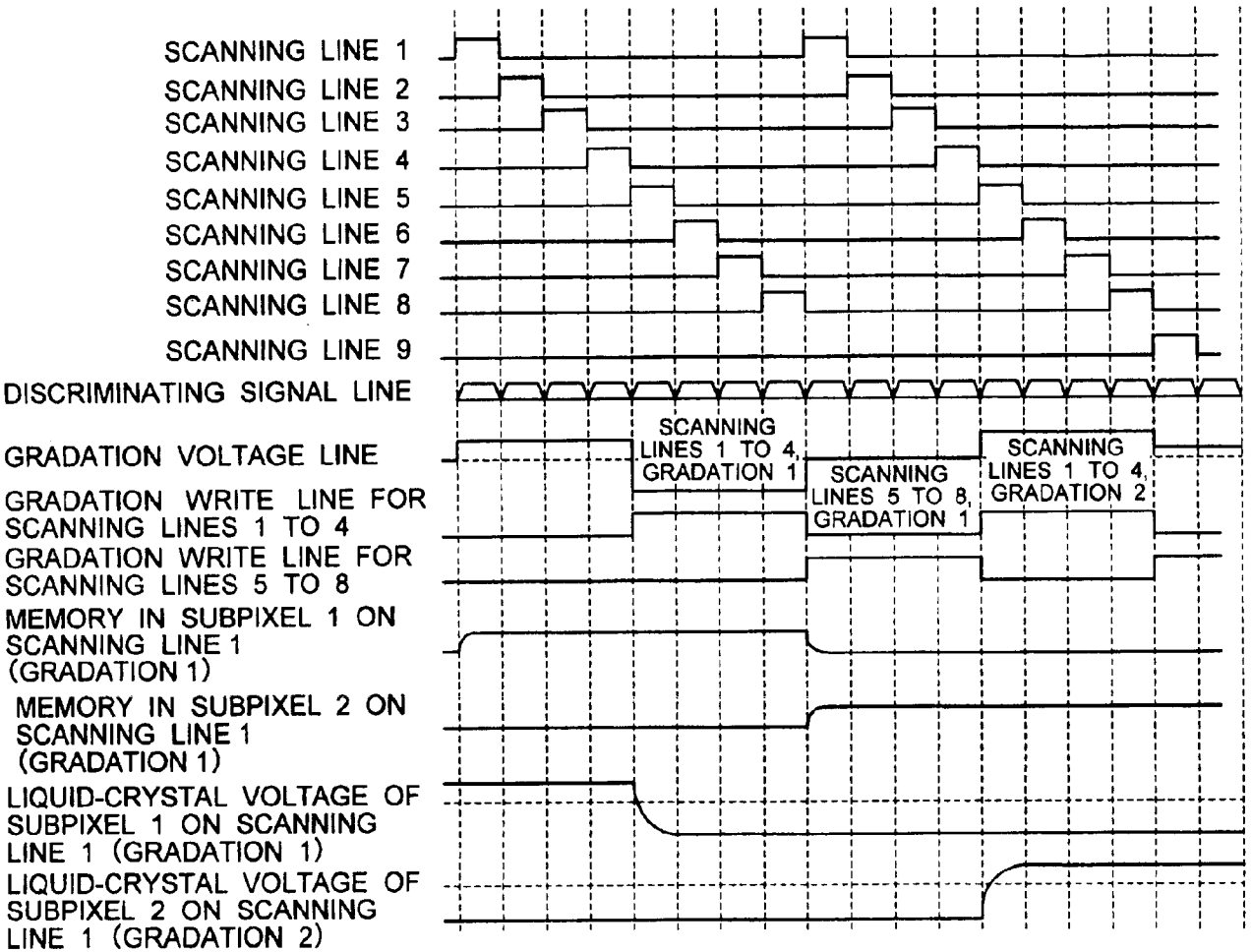
FIG. 7 is a timing chart showing a driving method of the embodiment of the display device.

Since only one gradation signal line is used in this embodiment, the gradation voltage can be written in pixels of one gradation level in one block by one gradation write pulse. For 2-gradation write operation, two gradation write pulses and two scanning pulses are required. FIG. 7 shows a duplicated scan driving method for this operation.

One block including 4 rows×4 columns is scanned using scanning lines 1 to 4 such that an Hi signal is written in subpixels of the block for which first gradation is to be displayed. While the scanning is conducted with scanning lines 5 and 6, the gradation write line for scanning lines 1 to 4 is selected such that potential of the first gradation corresponding to the blocks respectively of scanning lines 1 to 4 is fed from the gradation write line to be written in each associated subpixel electrode 111. During the operation since the second active element 108 for each subpixel for which second gradation is to be displayed is kept non-conductive, the gradation voltage is not applied to the subpixel electrode thereof even when the gradation write line is selected. Thereafter, the scanning is conducted with scanning lines 5 to 8 and then the scanning is conducted again with scanning lines 1 to 4. In this scanning operation, an Hi discriminating signal is written in subpixels of each block for which the second gradation is to be displayed. Therefore, while the scanning is conducted with scanning lines 5 to 8, a gradation voltage of the second gradation is written in the subpixel electrode of these subpixels.

In the duplicated scan driving method, the scanning must be twice conducted for each pixel, and hence the driving speed of this embodiment is not as high as that of the first embodiment. However, the driving speed is higher than that of the line-sequential driving method commonly used, and hence an increased amount of information can be displayed in this embodiment.

FIG. 8 shows the third embodiment of the display device in a block diagram. This embodiment differs from the first embodiment in that a duplicated scan timing controller 141 disposed in the liquid-crystal controller 136 is used to control the scanning lines 101 and the gradation write lines 105 for the duplicated scanning. Moreover, a line memory 140 including an discriminating signal 8-line memory and an discriminating signal 2-block-line memory to save the image data including the discriminating gradation signals up to the second scanning in the duplicated scanning. Since the third embodiment uses the duplicated scanning to display an image as described above, the circuit size of the liquid-crystal display controller 136 is slightly larger than that of the first embodiment. However, the received image data is not developed into a bit map in the memory on the display device side. That is, the transfer data can be directly displayed in the third embodiment, and hence the circuit size is only slightly increased.

As above, the third embodiment of the display device operates as follows. (1) The embodiment receives a video signal obtained by compressing data in a spatial axis and in a gradation axis, the data being in a unit of blocks each containing 4 pixels×4 pixels. (2) The received data is not developed into a bit map, but is used directly as display data, and hence it is not required to increase the circuit size of the display controller and the system can be configured at a low cost. (3) The display section includes only unipolar active elements and can be therefore produced at a low cost. When compared with the ordinary line-sequential driving method, the driving method of the third embodiment can conduct the driving operation at a higher speed. Therefore, an increased amount of information can be appropriately displayed.

In addition, the gradation voltage lines 1 (103) and 2 (104) can be shared among the red, green, and blue subpixels for four pixels (three pixels shown in FIG. 6) to remarkably reduce the number of wiring lines. The sharing of gradation voltage lines is not limited to four pixels, but can be applied to Ma wiring lines (Ma is an integer; $M \geqq Ma \geqq 2$) when each pixel block includes N rows and M columns. By sharing the first active element 106 among red, green, and blue subpixels, the number of active elements can be remarkably reduced. The aperture ratio can be improved by reducing the numbers respectively of wiring lines and active elements. Therefore, when compared with a display device having a backlight substantially equal to that of the embodiment of the present invention, the displayed image becomes brighter according to the present invention. Additionally, since the number of wiring lines per pixel becomes smaller, the number of short circuits between the wiring lines is reduced in the production of the display device to improve yield. Therefore, the display device can be produced at a low cost.

Also in the third embodiment, an LED element can be used for the light modulating element.

Although each block includes 4 pixels×4 pixels in the embodiment, each block may include N pixels×M pixels in the same configuration using the same driving method.

Although two gradation levels are defined in one block in the third embodiment, the number of gradation levels can be increased by increasing the number of scanning operations.

Embodiment 4

The fourth embodiment is substantially equal in structure to the third embodiment excepting features described below.

Figure 10:
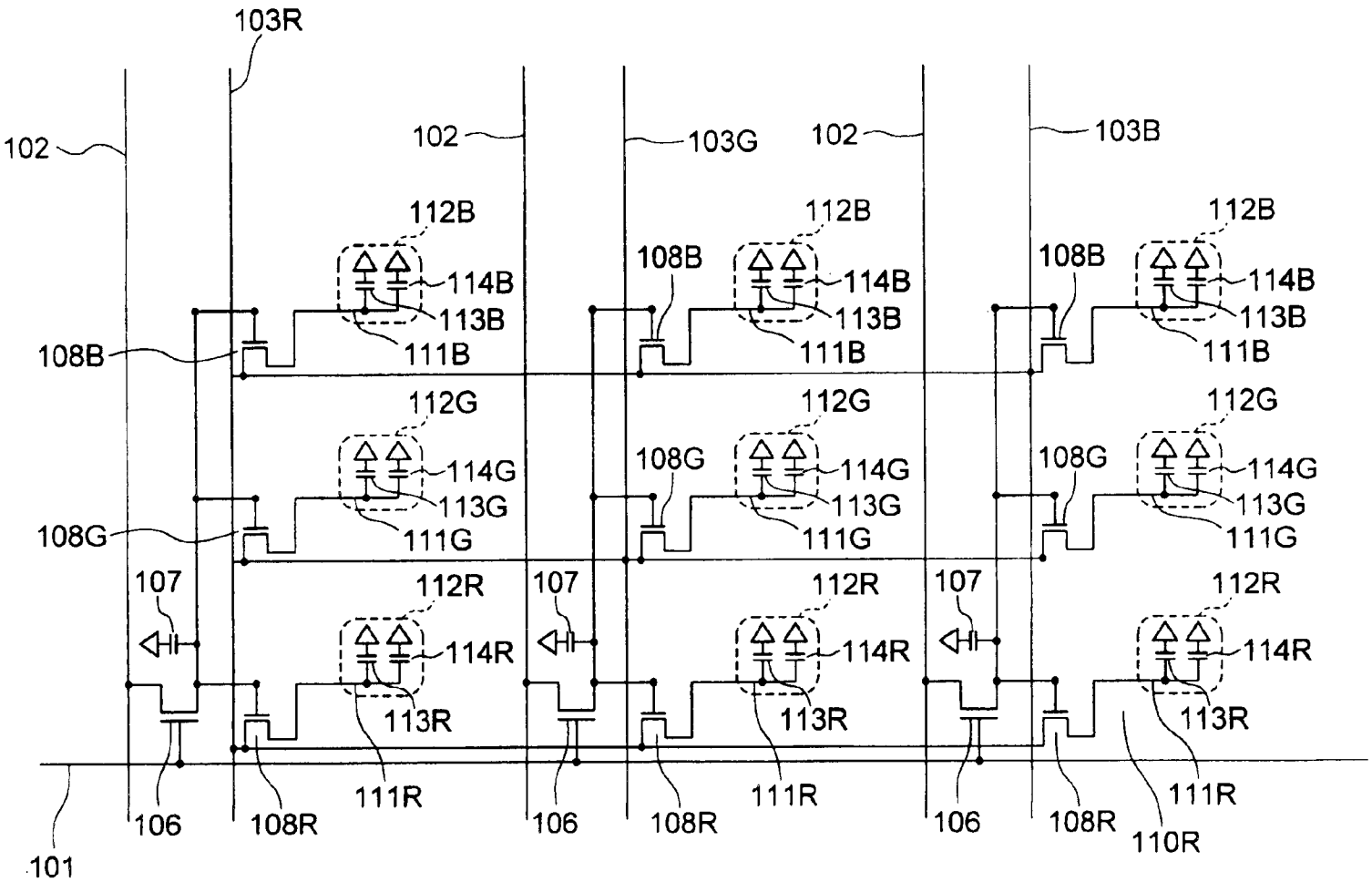
FIG. 10 is a diagram showing an equivalent circuit of a subpixel showing an embodiment of a display device.

FIG. 10 shows a subpixel of the embodiment of the display in a circuit diagram. This embodiment includes neither the gradation write line 105 used in the third embodiment nor the active element 110 of which the gate terminal is connected to the gradation write line 105. The output from the second active element is directly connected to the pixel electrode 111. Since one active element and one wiring line are reduced, yield is increased in the production process, and hence the production cost can be lowered.

Figure 11:
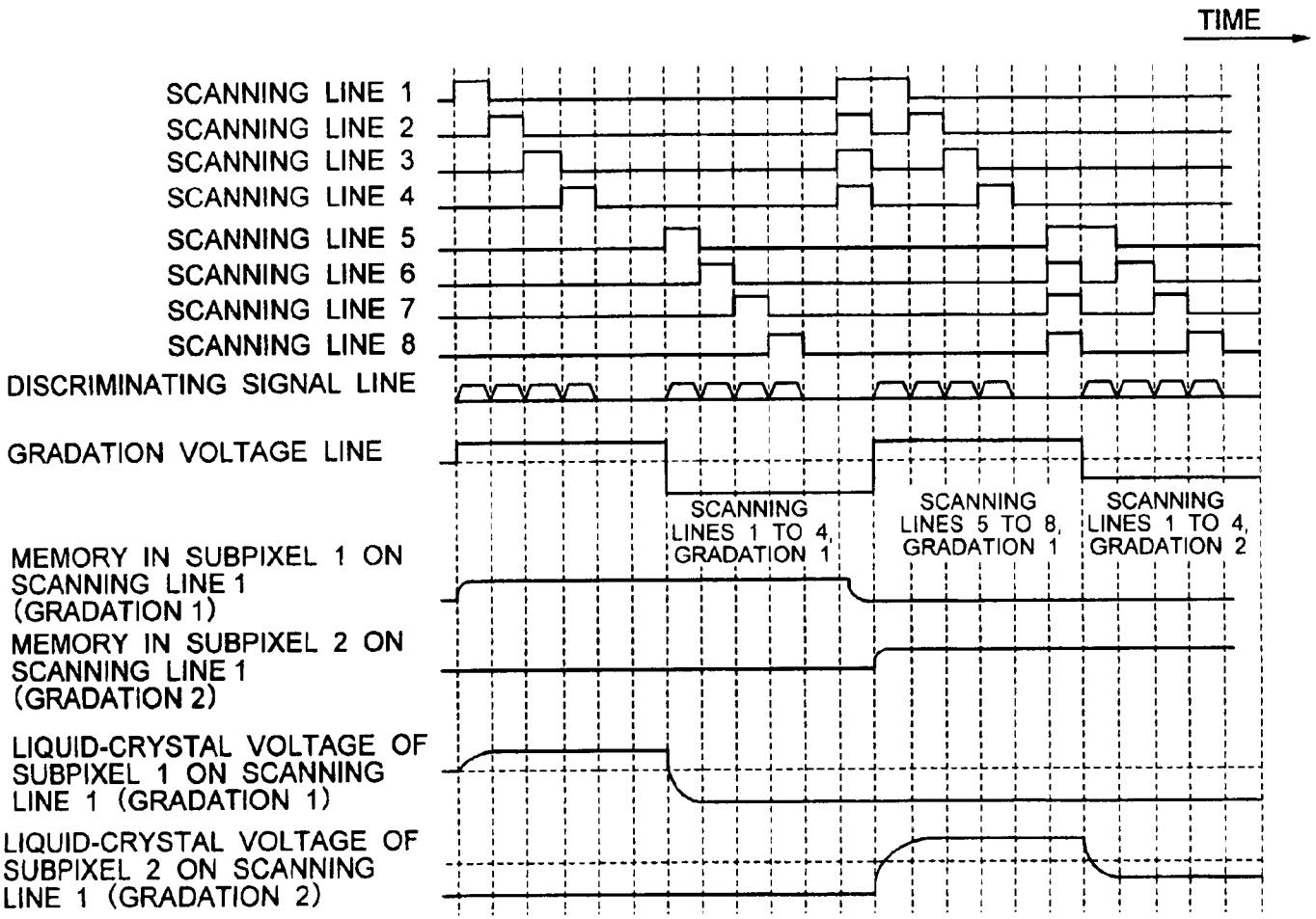
FIG. 11 is a timing chart showing a driving method of the embodiment of the display device.

Since the gradation write line is not disposed in this embodiment, the gradation voltage applied to the gradation voltage line 103 is written in any case in the subpixel electrode 111 in a pixel in which an Hi discriminating signal is written in the intra-pixel memory 107 even when the voltage is not associated with the block. To cope with this event, the duplicated scan driving method is modified such that after the gradation voltage is thus written, the scanning lines are again selected to write an Lo discriminating signal in the intra-pixel memory 107. FIG. 11 shows the operation. After the scanning lines 5 to 8 are selected, scanning lines 1 to 5 are simultaneously selected to write an Lo discriminating signal in the intra-pixel memory 107 of all pixels. Resultantly, the current potential of the gradation voltage line is finally held in the subpixel electrode 111. After scanning lines 1 to 4 are selected three times, scanning lines 5 to 8 are simultaneously selected to determine potential of each subpixel electrode of the subpixels connected to scanning lines 5 to 8. The driving method of the fourth embodiment requires a period of time in which four scanning lines are simultaneously selected to determine the subpixel electrode potential as above and hence the driving speed becomes lower when compared with the duplicated scan driving method of the third embodiment. However, the driving speed of the fourth embodiment is higher than that of the ordinary line-sequential driving method, and hence a larger amount of information can be appropriately displayed.

After the Lo discriminating signal is written via the discriminating signal line 102 in the intra-pixel memory 107, when the active element 106 turns off, the potential of the intra-pixel memory 107 is reduced by parasitic capacity of the active element. Therefore, it is necessary, in consideration of an off characteristic and the parasitic capacity of a transistor as the active element, to set a low level Vdl of the discriminating signal line to a slightly higher value in advance. Assume that the capacity values respectively of the intra-pixel memory 107, the on and off states of the active element 106, the on and off states of the active element 108, and the liquid-crystal layer (including the capacity 113) are represented as Cs, Cgs1on, Cgs1off, Cgs2on, Cgs2off, and Clc; and the high and low levels of the scanning line are respectively represented as Vgh and Vgl. Potential change ΔVdl is expressed as below.

$$\Delta Vdl \approx -(Cgs1on\,Vgh - Cgs1off\,Vgl)/(Cs + Cgs1on + 3Cgs2off - 3Cgs2off\,Cgs2off/(Clc + Cgs2off))$$

It is therefore necessary to set the low level DVl of the discriminating signal line by ΔVdl. As can be seen from the expression, the value of ΔVdl can be reduced by lowering the parasitic capacity Cgs. By setting the low level Vgl of the scanning line and the low level Vdl of the discriminating signal line to satisfy a condition of Vgl≧Vdl, the leakage current during the off state of the active element 108 can be reduced.

After the discriminating signal at the high level Vdh is written in the intra-pixel memory 107, when the active element 106 turns off, potential change ΔVdh becomes as below.

$$\Delta Vdh \approx -(Cgs1\text{on}Vgh - Cgs1\text{off}Vgl)/(Cs + Cgs1\text{off} + 3Cgs2\text{on})$$

To keep the potential sufficient to turn the active element 108 on, the capacity Cs in the intra-pixel memory 107 must be remarkably larger than the parasitic capacity to resultantly reduce ΔVdh. Assume the on current of the active element 106 is I1 and the on current of the active element 108 is I2. Since the liquid-crystal write time is six times that required in FIG. 11, a condition of I1≈6Cs/ClcI2. Therefore, it is only necessary to increase W/L of the active element 106 to charge the intra-pixel memory 107 during the scanning period, where L indicates a channel length of the active element and W indicates a channel width thereof. The active element 108 must have appropriate voltage precision to apply the gradation voltage. However, since the active element 106 provides digital data to turn the active element 108 on, there is not required quite high voltage precision. Even in consideration this condition, it is desired to hold I1≧I2.

Figure 9:
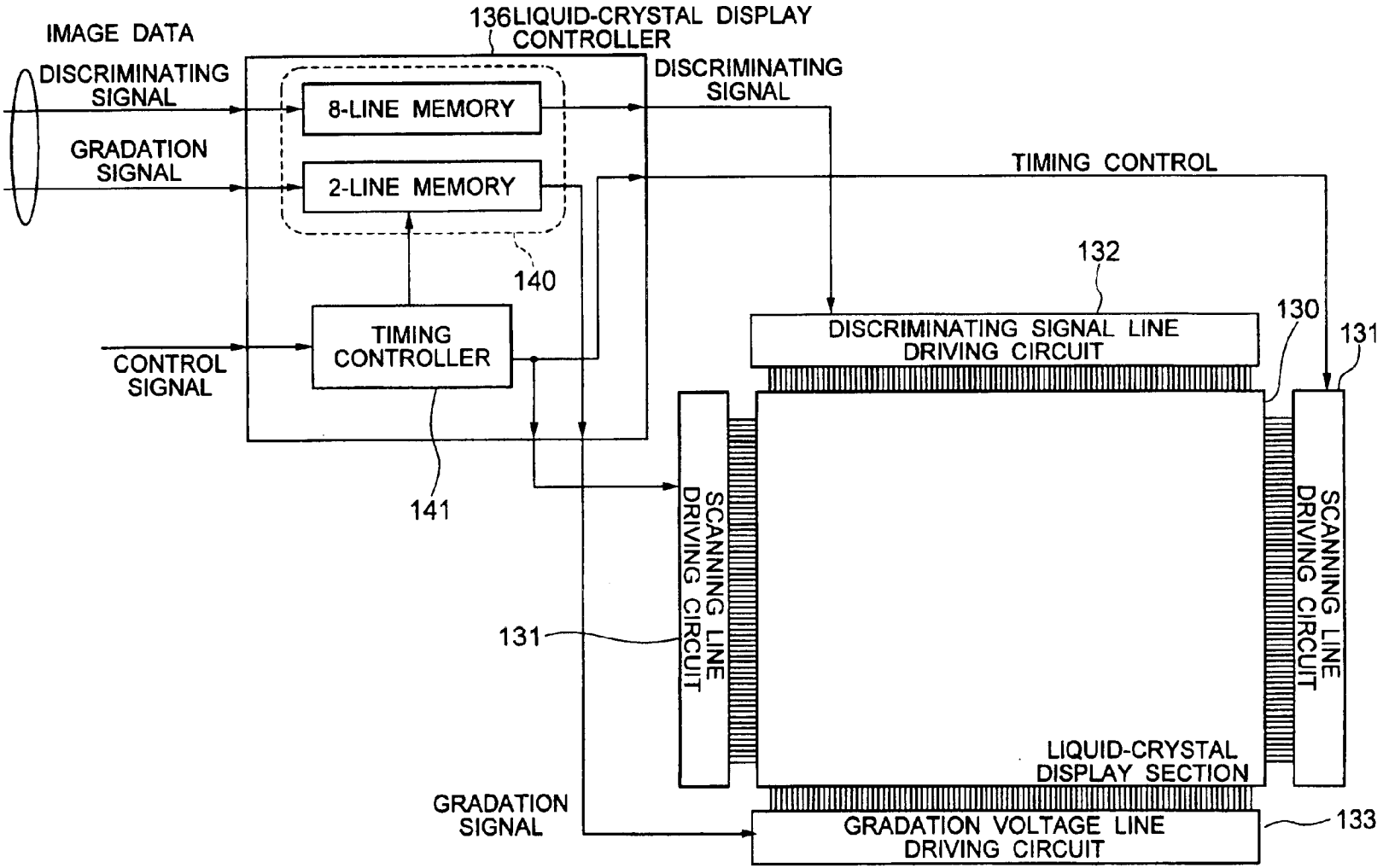
FIG. 9 is a block diagram showing an embodiment of a display device.
Figure 12:
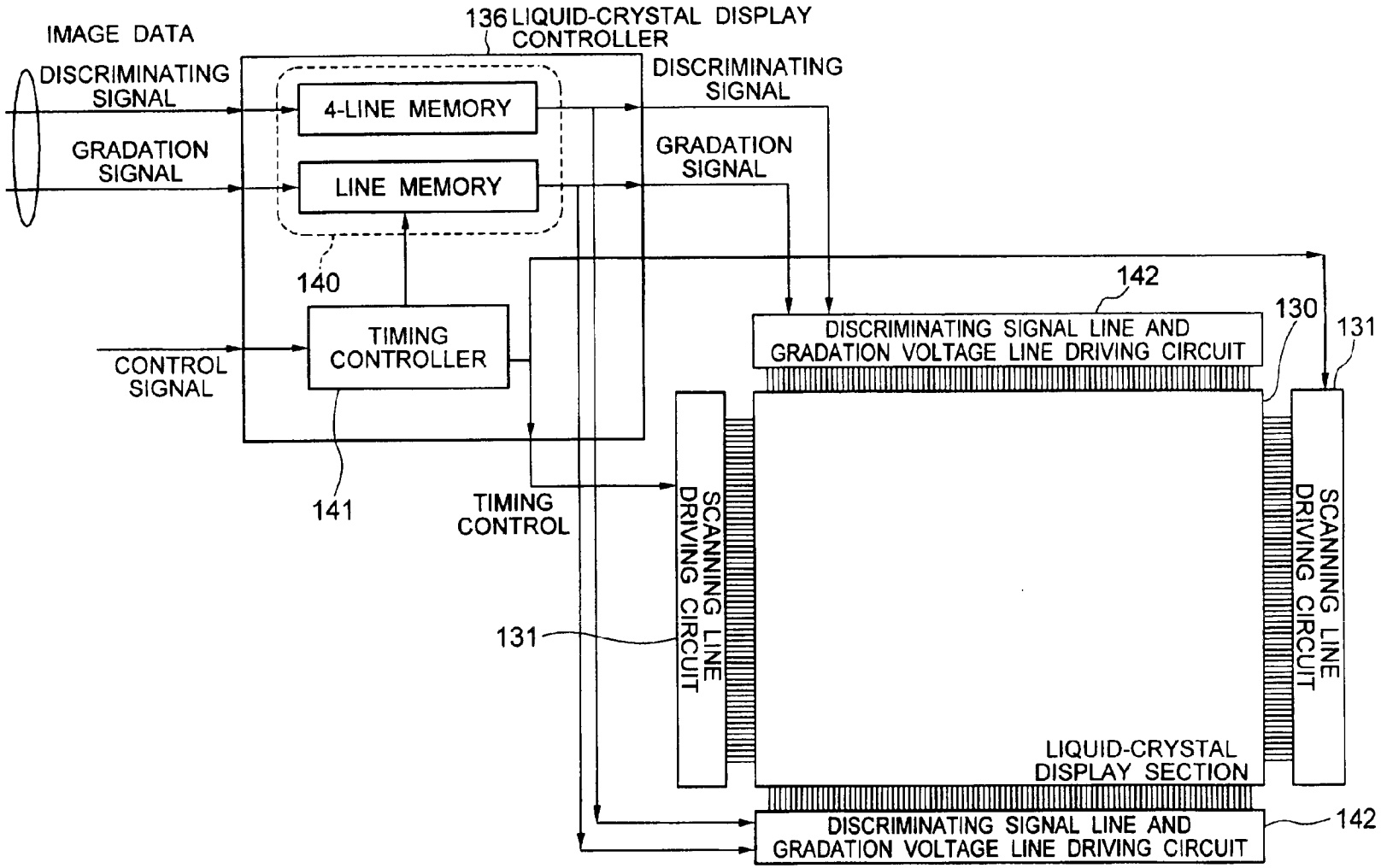
FIG. 12 is a block diagram showing an embodiment of a display device.

FIGS. 9 and 12 shows configurations of the embodiment of the display block in block diagrams. The configurations differ from that of FIG. 3 in that the gradation write driving circuit is removed and the gradation voltage line driver circuit is integrated with the discriminating signal line driver circuit into an discriminating signal line and gradation voltage line driver circuit. The integrated configuration of these circuits is not essential to the present invention and hence will not be described. However, since the gradation voltage line driver circuit is removed, the cost for the member and the like of the circuit is also removed. The display device can be therefore produced at a lower cost.

In the embodiment shown in FIG. 9, the scanning line driver circuits 131 are respectively disposed on the opposing sides of the liquid-crystal display section 130 to reduce distortion of signals by the wiring delay. The display device can therefore display a high definition image at a high speed. In FIG. 12, the discriminating signal line and gradation voltage line driver circuits 142 are respectively disposed on the opposing sides of the display section 130 to reduce distortion of signals by the wiring delay. The display device can therefore display a high definition image at a high speed. Additionally, when resolution is increased, the pitch for connection to peripheral driving circuits becomes smaller, and the connection becomes difficult. However, by drawing leads lines from both sides, the connection pitch becomes double and hence the connection is facilitated and yield is remarkably increased.

As described above, the fourth embodiment of the display device operates as follows. (1) The embodiment receives a video signal obtained by compressing data in a spatial axis and in a gradation axis, the data being in a unit of blocks each containing 4 pixels×4 pixels. (2) The received data is not developed into a bit map, but is used directly as display data, and hence it is not required to increase the circuit size of the display controller and the system can be configured at a low cost. (3) The display section includes only two unipolar active elements and can be therefore produced at a lower cost when compared with the third embodiment. In comparison with the ordinary line-sequential driving method, the driving method of the fourth embodiment can conduct the driving operation at a higher speed. Therefore, an increased amount of information can be appropriately displayed.

In addition, the gradation voltage line (103) can be shared among the red, green, and blue subpixels for four pixels (three pixels shown in FIG. 10) to remarkably reduce the number of wiring lines. The sharing of gradation voltage lines is not limited to four pixels, but can be applied to Ma wiring lines (Ma is an integer; M≧Ma≧2) when each pixel block includes N rows and M columns. By sharing the first active element 106 among red, green, and blue subpixels, the number of active elements can be remarkably reduced. The aperture ratio can be improved by reducing the numbers respectively of wiring lines and active elements. Therefore, when compared with a display device having a backlight substantially equal to that of the embodiment of the present invention, the displayed image becomes brighter according to the present invention. Additionally, since the number of wiring lines per pixel becomes smaller, the number of short circuits between the wiring lines is reduced in the production of the display device to improve yield. Therefore, the display device can be produced at a low cost.

Also in the third embodiment, an LED element can be used for the light modulating element.

Although each block includes 4 pixels×4 pixels in the embodiment, each block may include N pixels×M pixels in the same configuration using the same driving method.

Although two gradation levels are defined in one block also in the fourth embodiment, the number of gradation levels can be increased by increasing the number of scanning operations.

Embodiment 5

The fifth embodiment is substantially equal in structure to the third embodiment excepting features described below.

Figure 13:
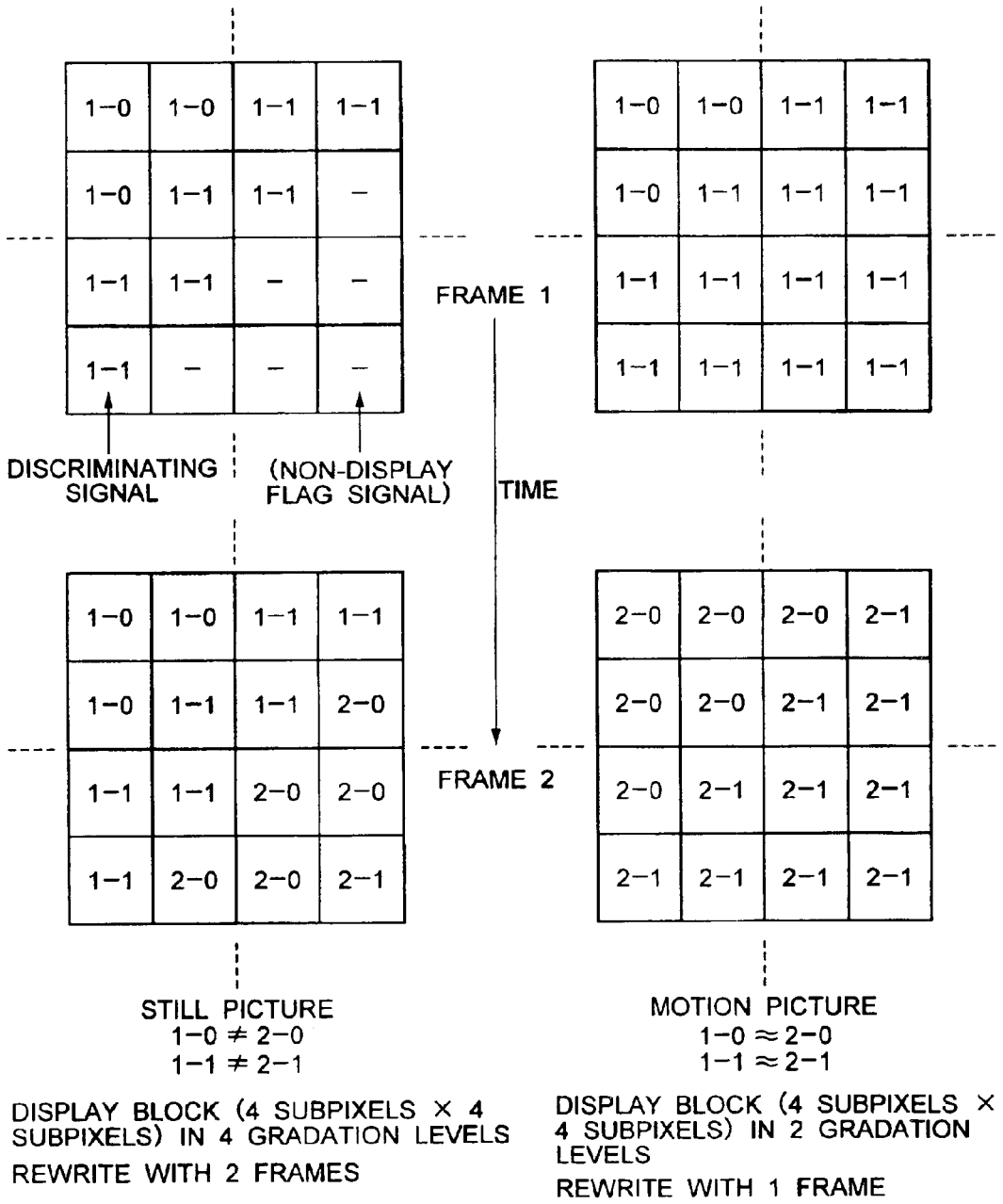
FIG. 13 is a diagram showing an image data layout to be received by the embodiment of the display device.

The display data which is to be received by the embodiment of the display device and which is improved in substantial transfer performance is obtained basically in almost the same compression method as in the first embodiment. However, in the fifth embodiment, a check is made for an image outputted from an image output source. For a motion picture area which has changed when compared with an immediately preceding frame, the intra-block gradation number or level is set to two and image data is transferred within one frame as shown in FIG. 13. For a motion picture area which has rarely changed when compared with an immediately preceding frame, the intra-block gradation number is set to four and image data is transferred for two frames. A first frame is used to transfer image data of subpixels for the first gradation and the second gradation and a second frame is used to transfer image data of subpixels for the third gradation and the fourth gradation. For a still picture area, also a flag signal of subpixels not displayed in each frame is simultaneously transferred. In the data transfer of this method, the compression ratios of the image in the still picture area is lower than that of the third embodiment. Therefore, the displayed image can be less distorted.

The subpixel configuration and the driving method of the fifth embodiment are almost the same as those of the third embodiment. Only one difference between the fifth and third embodiments is operation for the still picture area. To prevent the gradation signal in pixels in which the gradation signal is not required in the sill picture area, an discriminating signal at a high (Hi) level is multiplied by a flag signal in the liquid-crystal display controller 136 to thereafter output a resultant signal to the discriminating signal driving circuit. The circuit size is only slightly increased for this purpose.

As described above, the fifth embodiment operates as follows. (1) The embodiment receives a video signal obtained by compressing data in a spatial axis and in a gradation axis, the data being in a unit of blocks each containing 4 pixels×4 pixels. (2) The received data is not developed into a bit map, but is used directly as display data, and hence it is not required to increase the circuit size of the display controller and the system can be configured at a low cost. (3) The display section includes only unipolar active elements and can be therefore produced at a lower cost. In comparison with the ordinary line-sequential driving method, the driving method of the fourth embodiment can conduct the driving operation at a higher speed. Therefore, an increased amount of information can be appropriately displayed. Additionally, the image in the still picture area can be less distorted when compared with the third embodiment.

In addition, the gradation voltage line (103) can be shared among the red, green, and blue subpixels for four pixels to remarkably reduce the number of wiring lines. The sharing of gradation voltage lines is not limited to four pixels, but can be applied to Ma wiring lines (Ma is an integer; $M \geqq Ma \geqq 2$) when each pixel block includes N rows and M columns. By sharing the first active element 106 among red, green, and blue subpixels, the number of active elements can be remarkably reduced. The aperture ratio can be improved by reducing the numbers respectively of wiring lines and active elements. Therefore, when compared with a display device having a backlight substantially equal to that of the embodiment of the present invention, the displayed image becomes brighter according to the present invention. Additionally, since the number of wiring lines per pixel becomes smaller, the number of short circuits between the wiring lines is reduced in the production of the display device to improve yield. Therefore, the display device can be produced at a low cost.

Also in the fifth embodiment, an LED element can be used for the light modulating element.

Although each block includes 4 pixels×4 pixels in the embodiment, each block may include N pixels×M pixels in the same configuration using the same driving method.

Although two gradation levels are defined in one block of the motion picture area and four gradation levels are defined in one block of the still picture area in the fourth embodiment, the numbers of respective gradation levels can be increased by increasing the number of scanning operations.

Moreover, although four gradation levels are defined in one block of the still picture area for two frames in the embodiment, the number of frames can also be increased by keeping the gradation number assigned to each frame, for example, eight gradation levels can be used for four frames.

Embodiment 6

The sixth embodiment is substantially equal in structure to the fourth embodiment excepting features described below.

Figure 14:
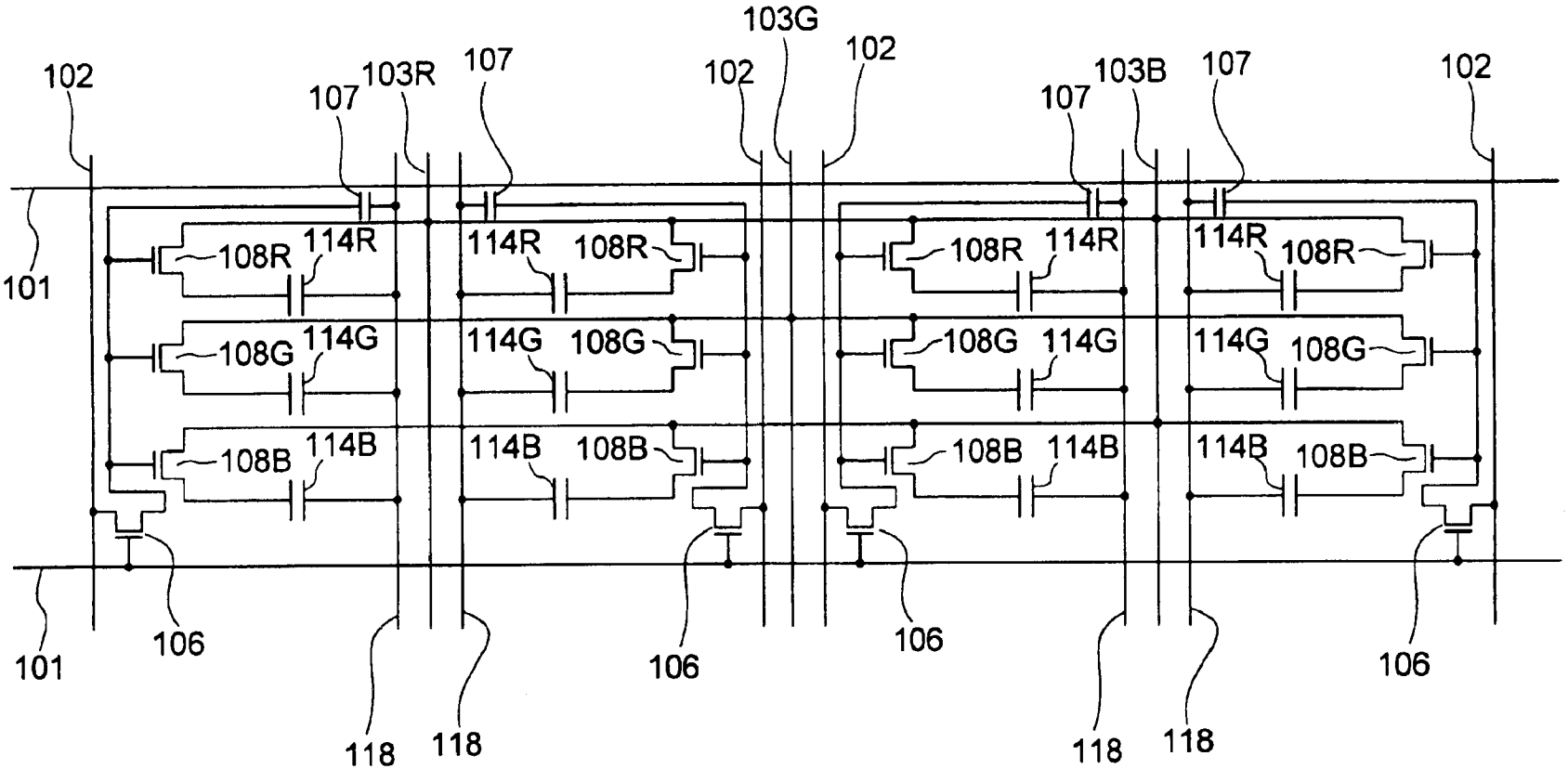
FIG. 14 is a block diagram showing an embodiment of a display device.

FIG. 14 shows an equivalent circuit of the embodiment of the display device. The embodiment is configured using a liquid-crystal display device as an example in which the number of wiring lines is remarkably reduced by sharing the gradation voltage line (103) among the red, green, and blue subpixels for four pixels. The number of active elements is remarkably reduced by sharing the first active element 106 among the red, green, and blue subpixels of the pixels. Table 1 shows comparison of the numbers respectively of transistors and active elements between the methods of the present invention and the method of the background art. In the circuit configuration of the cases above, shared wiring lines are drawn in a vertical direction. By arranging the shared wiring lines in the vertical direction, even when the voltage is applied via the gradation voltage line 103 to one block including, for example, four pixels×four pixels, the load imposed on the shared wiring lines can be reduced and hence deterioration of picture quality can be suppressed.

As a result, in the method in which the gradation voltage line is shared between two pixels, the number of transistors and that of vertical wiring lines (in the column direction) are slightly increased, but the number of horizontal wiring lines (in the row direction) is remarkably reduced when compared with the line-sequential method of the background art as shown in Table 1. When the gradation voltage line is shared among four pixels, the vertical wiring lines and the horizontal wiring lines can be remarkably reduced. By sharing the wiring lines, the interval or gap between the leading line can be increased to resultantly facilitate connection to peripheral circuits. This is suitable for a display device for high definition display.

TABLE 1

| Item | Transistors (total) | No. of vertical lines (total) | No. of horizontal lines (total) |
|---|---|---|---|
| Background art | 1/pixel (12) | 1/pixel (12) | 2/pixel (8) |
| Shared between 4 pixels | 1.3/pixel (16) | 0.9/pixel (11) | 0.25/pixel (1) |
| Shared between 2 pixels | 1.3/pixel (8) | 1.2/pixel (7) | 0.25/pixel (1) |

The sharing of gradation voltage lines is not limited to four pixels, but can be applied to Ma wiring lines (Ma is an integer; $M \geqq Ma \geqq 2$) when each pixel block includes N rows and M columns. The aperture ratio can be improved by reducing the numbers respectively of wiring lines and active elements. Therefore, when compared with a display device having a backlight substantially equal to that of the embodiment of the present invention, the displayed image becomes brighter according to the present invention. Additionally, since the number of wiring lines per pixel becomes smaller, the number of short circuits between the wiring lines is reduced in the production of the display device to improve yield. Therefore, the display device can be produced at a low cost.

Embodiment 7

FIGS. 15A to 15C and FIGS. 16A and 16B show structure of a pixel of the embodiment, the structure being shown as an example of a transversal electric field mode. The embodiment is implemented by modifying the equivalent circuits shown in FIGS. 10 and 13 as follows. The gradation voltage line 103 is shared between two pixels and the first active element 106 is shared among the red, green, and blue subpixels of each pixel to thereby reduce the numbers respectively of wiring lines and transistors.

Figure 15A:
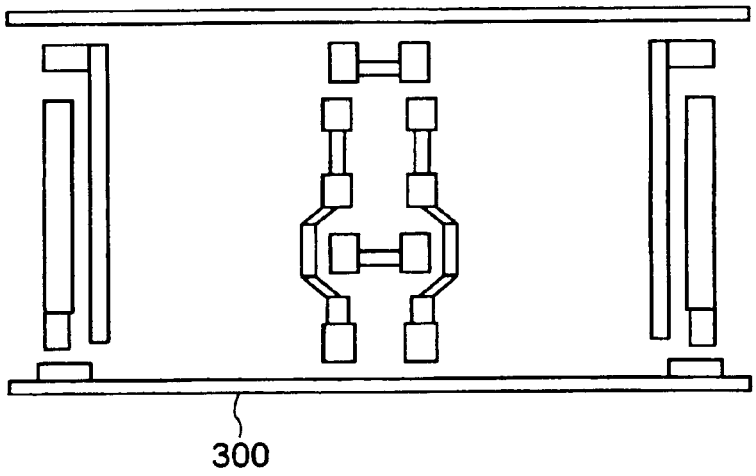
FIGS. 15A, 15B, and 15C are plan views showing a subpixel in an embodiment of a display device.
Figure 15B:
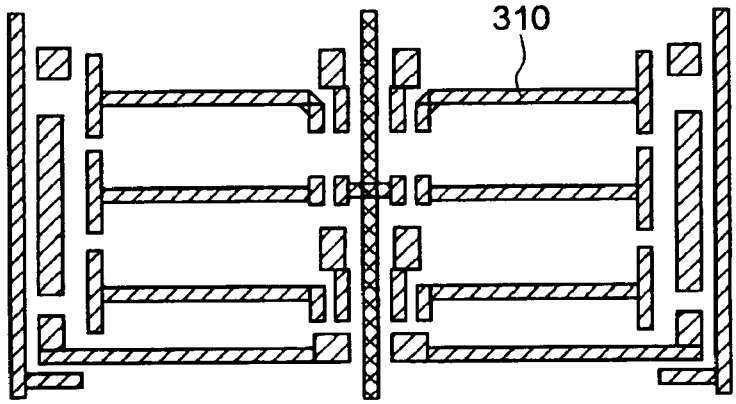
Figure 15C:
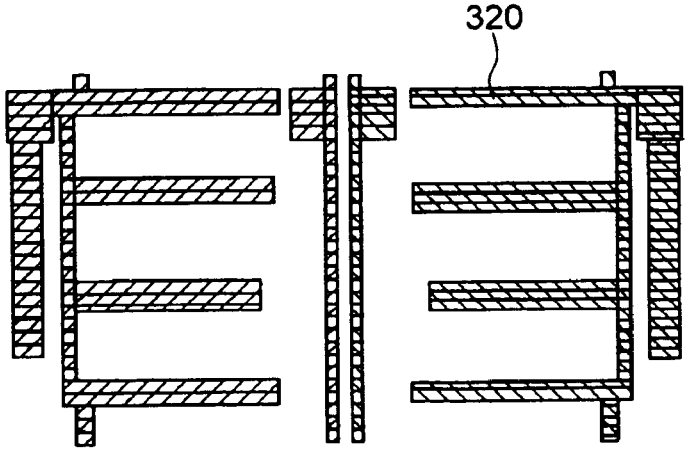
Figure 16A:
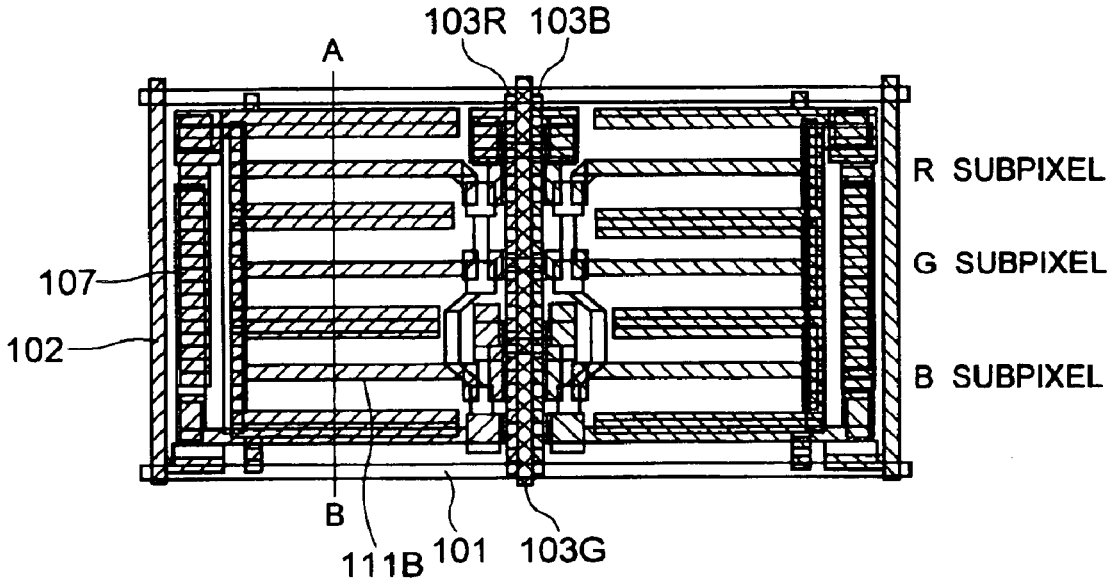
FIGS. 16A and 16B are respectively a plan view and a cross-sectional view of a pixel in an embodiment of a display device.
Figure 16B:
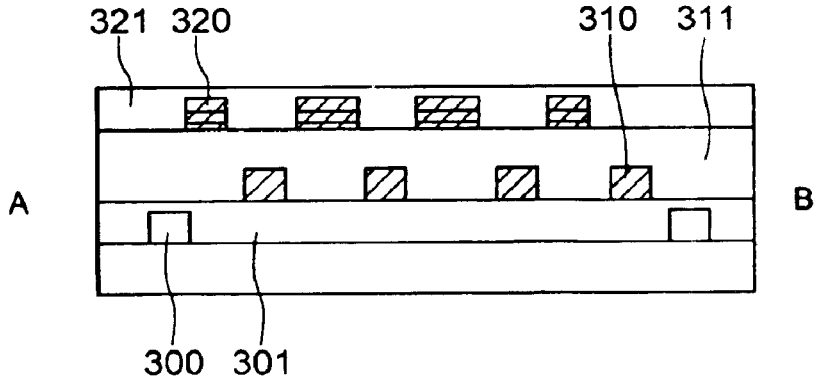

To simplify description, FIGS. 15A, 15B, and 15C show first-layer metallic wiring 300, second-layer metallic wiring 310, and third-layer metallic wiring 320, respectively. FIG. 16A shows a plan view in which three layers of FIGS. 15A to 15C are overlapped with each other. FIG. 16B shows a cross-sectional view of FIG. 16A along line AB. Contact holes, silicon layers, and the like other than the three-layer wiring are not shown.

To increase the aperture ratio, in addition to the sharing of the active element and the gradation voltage line, the red gradation voltage line (R) 103R and the blue gradation voltage line (B) 103B are formed by the third-layer metallic wiring 320 and the green gradation voltage line (G) 103G is formed by the second-layer metallic wiring 310. By using two layers as above, the gap between the wiring lines can be reduced without lowering the yield. When an organic insulating film of coating type is used as an insulation film between the second-layer metallic wiring 310 and the third-layer metallic wiring 320, it is possible to prevent increase of capacity between wiring layers.

Although the common wiring is shared between two pixels in the embodiment, when the number of pixels is increased, the number of leading lines can be reduced. However, the number of shared wiring lines increases in each block, and hence the aperture ratio is possibly lowered in some cases. Even when the number of pixels to share the wiring is increased, the lowering of the aperture ratio can be prevented by configuring, for example, the second-layer metallic wiring 310 and the third-layer metallic wiring 320 in an overlapped state. In this configuration, an organic insulation film of coating type is favorably used to prevent increase of capacity between the wiring layers. To prevent deterioration of picture quality by a leakage electric field due to the overlapped configuration of the wiring layers, width of each of the shared electrodes and subpixel electrodes exerting influence onto the picture quality is increased to be wider than the shared wiring disposed therebelow. This resultantly suppresses the leakage electric field and hence prevents the deterioration in picture quality.

When the third-layer metallic wiring 320 is directly brought into contact with the liquid crystal, the picture quality is deteriorated depending on cases. It is therefore favorable to form an organic insulation film of coating type on the third-layer metallic wiring 320.

In the configuration above, the aperture ratio can be improved. Therefore, when compared with a display device having a backlight substantially equal to that of the embodiment of the present invention, the displayed image becomes brighter according to the present invention. Additionally, since the number of wiring lines per pixel becomes smaller, the number of short circuits between the wiring lines is reduced in the production of the display device to improve yield. Therefore, the display device can be produced at a low cost.

The sharing of gradation voltage lines is not limited to two pixels, but can be applied to Ma wiring lines (Ma is an integer; $M \geqq Ma \geqq 2$) when each pixel block includes N rows and M columns.

According to the embodiments, (1) display data with substantially improved transfer performance using the digital PV link method or the image compression method associated with a spatial axis, a gradation axis, and a time axis is received, (2) the processing performance of the data processor circuit is only slightly improved and hence the cost is not increased, and (3) a large amount of information can be normally displayed.

The gradation voltage line can be shared among the red, green, and blue subpixels of a plurality of pixels, and hence the number of wiring lines is remarkably reduced. By sharing the first active element among the red, green, and blue subpixels, the number of active element can be remarkably reduced. Since the numbers respectively of wiring lines and active are thus reduced, the aperture ratio is improved. Consequently, the displayed image becomes brighter according to the present invention when compared with a display device having a backlight substantially equal to that of the present invention.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A display device, comprising:

a plurality of blocks of pixels each of which includes subpixels respectively of three colors, each of said blocks including pixels in a form of a matrix having N rows and M columns;

a subpixel electrode disposed in each said pixel;

a display element disposed in said each subpixel, said element operating according to a voltage on said subpixel electrode;

a scanning line driving circuit for supplying a scanning signal to scanning lines arranged substantially parallel to each other;

a discriminating signal line driving circuit for supplying a discriminating signal to discriminating signal lines arranged substantially vertical to said scanning lines;

holding means for holding in said pixel a discriminating signal from said discriminating line;

a gradation voltage line driving circuit for supplying a gradation voltage to Ma gradation voltage lines for supplying a gradation voltage to each said subpixel, said Ma gradation voltage lines being commonly connected (Ma is an integer; $M \geqq Ma \geqq 2$) for said subpixels respectively of three colors of red, green, and blue in a direction of the column;

a circuit for selecting a gradation voltage according to said discriminating signal; and a switch for applying the gradation voltage selected by said selecting circuit to said subpixel electrode, wherein said scanning lines, said discriminating signal lines, and gradation voltage lines include three layers of metallic wiring including first, second, and third metallic wiring, and a coating-type insulation film is formed between said second metallic wiring and said third metallic wiring.

2. A display device according to claim 1, wherein said three colors are red, green, and blue.

3. A display device, comprising:

a plurality of blocks of pixels each of which includes subpixels respectively of three colors, each of said blocks including pixels in a form of a matrix having N rows and M columns;

a subpixel electrode disposed in each said pixel;

a display element disposed in said each subpixel, said element operating according to a voltage on said subpixel electrode;

a scanning line driving circuit for supplying a scanning signal to scanning lines arranged substantially parallel to each other;

a discriminating signal line driving circuit for supplying a discriminating signal to discriminating signal lines arranged substantially vertical to said scanning lines;

holding means for holding in said pixel a discriminating signal from said discriminating line;

a gradation voltage line driving circuit for supplying a gradation voltage to Ma gradation voltage lines of said gradation voltage lines for supplying a gradation voltage to each said subpixel, said Ma gradation voltage lines being commonly connected (Ma is an integer; M≧Ma≧2) for said subpixels respectively of three colors of red, green, and blue in a direction of the column;

a circuit for selecting a gradation voltage according to said discriminating signal; and a switch for applying the gradation voltage selected by said selecting circuit to said subpixel electrode.

4. A display device according to claim 3, wherein:

said display element is a light modulating element using liquid crystal;

said holding circuit includes a first active element which includes said scanning line as a gate terminal thereof and which is respectively shared among subpixels respectively of the three colors connected to said discriminating line and intra-pixel memory capacity, and two gradation voltage lines are arranged for one subpixel;

said gradation voltage selecting circuit includes an n-type active element and a p-type active element of which respective gate terminals are connected to said intra-pixel memory capacity and which are respectively connected to two gradation voltage lines; and said switch includes a fourth active element connected to an (n, p)-type active element and said subpixel electrode, said fourth active element including a gradation write line as a gate terminal thereof.

5. A display device according to claim 3, wherein:

said display element is a light modulating element;

said holding circuit includes a first active element which includes said scanning line as a gate terminal thereof and which is respectively shared among subpixels respectively of the three colors connected to said discriminating line and intra-pixel memory capacity, and two gradation voltage lines are arranged for one subpixel;

said gradation voltage selecting circuit includes an n-type active element and a p-type active element of which respective gate terminals are connected to said intra-pixel memory capacity and which are respectively connected to two gradation voltage lines;

said switch includes a fourth active element connected to an (n, p)-type active element and said subpixel electrode, said fourth active element including a gradation write line as a gate terminal thereof; and said display element is a light emitting diode (LED) element which includes said subpixel electrode as a gate terminal thereof and which is driven by a fifth active element.

6. A display device according to claim 3, wherein:

said display element is a light modulating element using liquid crystal;

said holding circuit includes a first active element which includes said scanning line as a gate terminal thereof and which is shared among subpixels respectively of the three colors connected to said discriminating line and intra-pixel memory capacity, and one said gradation voltage line is arranged for one said subpixel;

said gradation voltage selecting circuit includes an n-type active element and a p-type active element of which respective gate terminals are connected to said intra-pixel memory capacity and which are respectively connected to two gradation voltage lines of an adjacent subpixel and own pixel, respectively; and said switch includes a fourth active element connected to an (n, p)-type active element and said subpixel electrode, said fourth active element including a gradation write line as a gate terminal thereof.

7. A display device according to claim 3, wherein:

said display element is a light modulating element using liquid crystal;

said holding circuit includes a first active element which includes said scanning line as a gate terminal thereof and which is shared among subpixels respectively of the three colors connected to said discriminating line and intra-pixel memory capacity, and one said gradation voltage line is arranged for one said subpixel;

said circuit to select an output of the gradation voltage includes a second active element of which a gate terminal is connected to said intra-pixel memory capacity and which and which is connected to said gradation voltage line; and said switch includes a third active element connected to said second active element and said subpixel electrode, said third active element including a gradation write line as a gate terminal thereof.

8. A display device according to claim 3, wherein:

said display element is a light modulating element using liquid crystal;

said holding circuit includes a first active element which includes said scanning line as a gate terminal thereof and which is shared respectively among subpixels respectively of the three colors connected to said discriminating line and intra-pixel memory capacity, and one said gradation voltage line is arranged for one said subpixel;

said circuit to output the gradation voltage to said subpixel electrode includes a second active element of which a gate terminal is connected to said intra-pixel memory capacity and which is connected to said gradation voltage line.

9. A display device according to claim 3, wherein said scanning lines have a low level of Vgl and said discriminating signal lines have a low level of Vdl, where Vgl≧Vdl.

10. A display device according to claim 3, wherein said scanning lines, said discriminating signal lines, and gradation voltage lines are drawn to both sides of said display device.

11. A display device according to claim 4, wherein:

said first active element has an on current of I1;

said second active element has an on current of I2; and said first and second active elements are configured to hold I1≧I2.

12. A display device, comprising:

a plurality of blocks of pixels each of which includes subpixels respectively of three colors, each of said blocks including pixels in a form of a matrix having N rows and M columns, wherein said display device receives an image data signal after image compression, and directly displays a compressed image signal without developing the image signal into a bit map in which each subpixel has gradation information, and wherein the compressed image signal is being decompressed within said display device before displayed on said display device, so that an image displayed corresponds to an original image represented by the image signal before image compression.

13. A display device according to claim 12, wherein said image signal is compressed in a spatial axis and in a gradation axis before transmission to said display device.

14. A display device according to claim 12, wherein said three colors are red, green and blue.

15. A display device according to claim 12, further comprising:

a first active element shared among three subpixels constituting each said pixel; and a second active element constructed for each said subpixel connected to said first active element.

16. A display device according to claim 12, further comprising:

Ma gradation voltage lines of gradation voltage lines commonly connected (Ma is an integer; $M \geqq Ma \geqq 2$) for said subpixels respectively of three colors in a direction of the column.

17. A display device comprising:

a plurality of blocks of pixels each of which includes subpixels respectively of three colors, each of said blocks including pixels in a form of a matrix having N rows and M columns, wherein said display device directly displays a compressed image signal without developing the image signal into a bit map in which each subpixel has gradation information;

wherein said display device operates in an image compression and transfer method in which a lookup table of n gradation levels (n is less than N×M) is defined for said pixel block before said pixel block is transferred and a discriminating signal having gradation thereof is transferred for each pixel in said pixel block, and wherein said display device displays an image signal of the image compression and transfer method without developing the image signal.

18. A display device comprising:

a plurality of blocks of pixels each of which includes subpixels respectively of three colors, each of said blocks including pixels in a form of a matrix having N rows and M columns, wherein said display device directly displays a compressed image signal without developing the image data into a bit map in which each subpixel has gradation information; and wherein said display device operates in an image compression and transfer method in which a lockup table of n gradation levels (n is less than N×M) is defined for each pixel block of which gradation frequently changes between a plurality of frames, before said pixel block is transferred, and a discriminating signal having gradation thereof is transferred for each pixel in said pixel block, and wherein said display device displays an image signal of the image compression and transfer method without developing the image signal.

19. A display device comprising:

a plurality of blocks of pixels each of which includes subpixels respectively of three colors, each of said blocks including pixels in a form of a matrix having N rows and M columns, wherein said display device directly displays a compressed image signal without developing the image data into a bit map in which each subpixel has gradation information;

wherein said display device operates in an image compression and transfer method in which a lookup table of m gradation levels (m is less than N×M) for a plurality of frames is defined for each pixel block of which gradation changes less frequently between a plurality of frames, before said pixel block is transferred, and a discriminating signal having gradation thereof for a plurality of frames is transferred for each pixel in said pixel block, and in which a lookup table of n gradation levels (n is less than N×M; m>n) in a single frame is defined for each pixel block of which gradation changes frequently between a plurality of frames, before said pixel block is transferred, and a discriminating signal having gradation thereof in the single frame is transferred for each pixel in said pixel block, and wherein said display device displays an image signal of the image compression and transfer method without developing the image signal.

* * * * *